US008567149B2

(12) United States Patent
Kuzmin

(10) Patent No.: US 8,567,149 B2
(45) Date of Patent: Oct. 29, 2013

(54) INTERLOCKING SPATIAL COMPONENTS

(75) Inventor: Yevgeniy Pavlovich Kuzmin, Staten Island, NY (US)

(73) Assignee: Microth, Inc., Staten Island, NY (US)

( * ) Notice: Subject to any disclaimer, the term of this patent is extended or adjusted under 35 U.S.C. 154(b) by 1272 days.

(21) Appl. No.: 12/268,105

(22) Filed: Nov. 10, 2008

(65) Prior Publication Data

US 2009/0117311 A1 May 7, 2009

Related U.S. Application Data

(63) Continuation-in-part of application No. PCT/US2008/059894, filed on Apr. 10, 2008.

(60) Provisional application No. 60/911,561, filed on Apr. 13, 2007, provisional application No. 60/982,860, filed on Oct. 26, 2007, provisional application No. 60/990,795, filed on Nov. 28, 2007.

(51) Int. Cl.
*E04C 1/00* (2006.01)

(52) U.S. Cl.
USPC ..... 52/592.1

(58) Field of Classification Search
USPC ..... 52/592.1, 592.6, 604, 605; 446/125, 446/127
See application file for complete search history.

(56) References Cited

U.S. PATENT DOCUMENTS

| | | | | | |
|---|---|---|---|---|---|
| 115,961 | A | * | 6/1871 | Hopkins | 52/848 |
| 253,416 | A | * | 2/1882 | O'Brien | 52/218 |
| 607,812 | A | * | 7/1898 | Van Wie | 52/592.6 |
| 834,950 | A | * | 11/1906 | Van Wie | 52/589.1 |
| 2,653,450 | A | * | 9/1953 | Fort | 405/287 |
| 2,892,340 | A | * | 6/1959 | Fort | 52/223.7 |
| 3,176,468 | A | * | 4/1965 | Nagai et al. | 405/29 |
| 3,340,781 | A | * | 9/1967 | See | 404/41 |
| 3,970,314 | A | * | 7/1976 | Mayr et al. | 273/156 |
| 4,083,190 | A | * | 4/1978 | Pey | 405/33 |
| 4,423,465 | A | | 12/1983 | Teng-Ching et al. | |
| 4,481,155 | A | * | 11/1984 | Frohwerk | 261/94 |
| 5,448,868 | A | | 9/1995 | Lalvani | |
| 5,520,396 | A | | 5/1996 | Therrien | |
| 5,803,660 | A | * | 9/1998 | Warren et al. | 405/25 |
| 5,853,314 | A | | 12/1998 | Bora | |
| 5,947,885 | A | | 9/1999 | Paterson | |
| 6,173,538 | B1 | | 1/2001 | Fleishman | |
| 6,477,814 | B1 | * | 11/2002 | Kadosh | 52/439 |
| 2004/0221529 | A1 | | 11/2004 | Zornes | |
| 2007/0006542 | A1 | | 1/2007 | Duke | |
| 2007/0266667 | A1 | | 11/2007 | Rapaz | |
| 2007/0266669 | A1 | | 11/2007 | Rapaz | |

FOREIGN PATENT DOCUMENTS

| | | | | |
|---|---|---|---|---|
| EP | 13535 | A1 * | 7/1980 | E02D 29/02 |

OTHER PUBLICATIONS

International Search Report for PCT/US08/59894; Search completed Jul. 28, 2008.

PixelBlocks—Educational Toys, pp. 1-2, http://www.educationaltoys.co.uk/productcart/pc/viewCat_P.asp?idCategory=38 Jan. 29, 2007.

(Continued)

*Primary Examiner* — Christine T Cajilig
(74) *Attorney, Agent, or Firm* — Alston & Bird LLP

(57) ABSTRACT

The present invention relates generally to interlocking spatial components, and more particularly to spatial components having mating surfaces of uniform periodical structure comprising a regular array of interlocking connectors of the same shape allowing components to be arbitrarily interlocked along various relative directions, in various relative orientations, and upon various sides and to be assembled with one another to create spatial structures.

26 Claims, 30 Drawing Sheets

(56) References Cited

OTHER PUBLICATIONS

Polyhedron—from Wolfram MathWorld, pp. 1-6 http://mathworld.wolfram.com/Polyhedron.html; Feb. 19, 2007.

Archimedean Solid—from Wolfram Math World, pp. 1-12 http://mathworld.wolfram.com/ArchimedeanSolid.html; Feb. 19, 2007.

Warp Nine Engineering—The IEEE 1284 Experts—IEEE 1284 Connectors, pp. 1-2 http://www.fapo.com/1284conn.htm; Feb. 28, 2007.

DE-9 connector—Wikipedia, the free encyclopedia, pp. 1-2 http://en.wikipedia.org/wiki/DE-9_connector; Feb. 28, 2007.

Talking Serially: RS-232:connectors and Cabling, pp. 1-4 http://www.uwsg.iu.edu/usail/peripherals/serial/rs232/ Feb. 28, 2007.

Serial and Parallel cable schematics and wiring diagrams, pp. 1-5 http://www.jspayne.com/io/schematics.html; Feb. 28, 2007.

Endura-Form; Introducing ENDURA-FORM Multi Purpose Construction Panels; pp. 1-2; http://www.icechiller.net/endura-form/index.html; Mar. 3, 2008.

Endura-Form—The Panel; Multi Purpose Construction Panels; pp. 1-3; http://www.icechiller.net/endura-form/panel.html; Mar. 3, 2008.

Endura-Form—Applications—Commercial/Industrial; pp. 1-4; http://www.icechiller.net/endura-form/applications-commercial.html; Feb. 12, 2008.

Endura-Form—Applications—Endura-Form—Residential; p. 1; http://www.icechiller.net/endura-form/applications-residential.html; Feb. 12, 2008.

Endura-Form—Applications—Endura-Form—Agriculture; p. 1; http://www.icechiller.net/endura-form/applications-agricultural.html; Feb. 12, 2008

Internet Image of Stickle Bricks, http://upload.wikimedia.org/wikipedia/commons/f/fl/Stickle_bricks.jpg, Oct. 4, 2011.

* cited by examiner

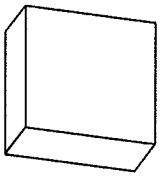
FIG. 2A.1
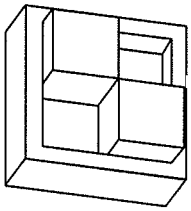
FIG. 2A.2
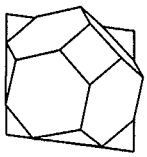
FIG. 2B.1
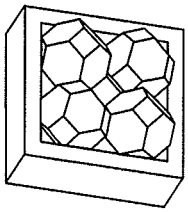
FIG. 2B.2
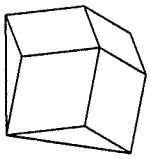
FIG. 2C.1
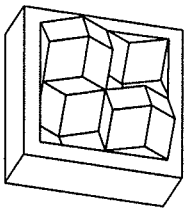
FIG. 2C.2
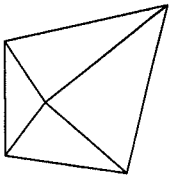
FIG. 2D.1
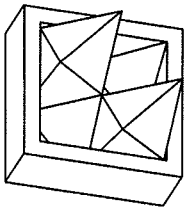
FIG. 2D.2
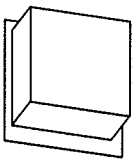
FIG. 2E.1
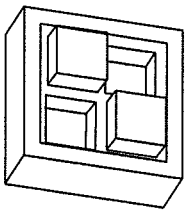
FIG. 2E.2
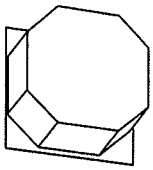
FIG. 2F.1
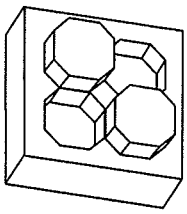
FIG. 2F.2

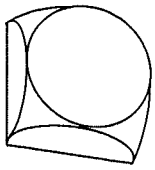
FIG. 3A.1
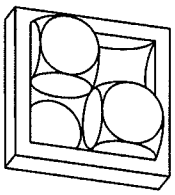
FIG. 3A.2
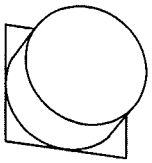
FIG. 3B.1
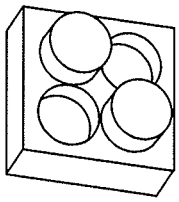
FIG. 3B.2
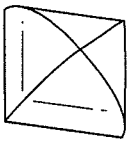
FIG. 3C.1
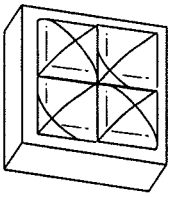
FIG. 3C.2
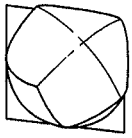
FIG. 3D.1
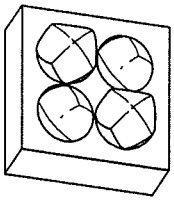
FIG. 3D.2
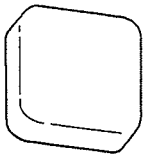
FIG. 3E.1
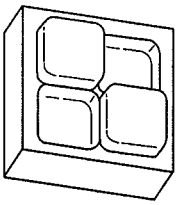
FIG. 3E.2
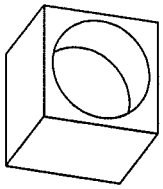
FIG. 3F.1
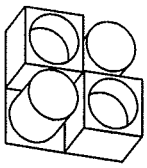
FIG. 3F.2

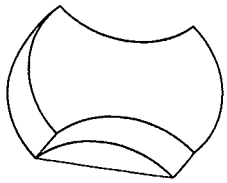
FIG. 6A
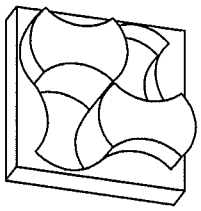
FIG. 6B
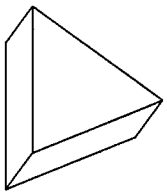
FIG. 7A.1
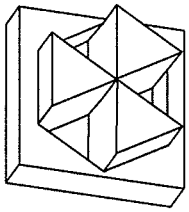
FIG. 7A.2
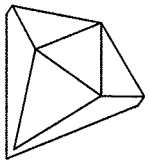
FIG. 7B.1
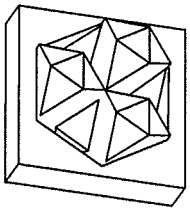
FIG. 7B.2
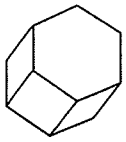
FIG. 7C.1
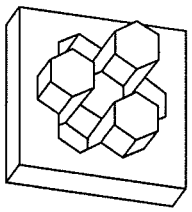
FIG. 7C.2
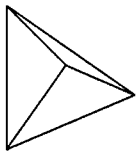
FIG. 7D.1
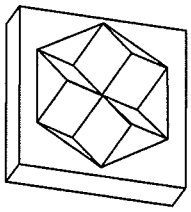
FIG. 7D.2

INTERLOCKING SPATIAL COMPONENTS

CROSS-REFERENCE TO RELATED APPLICATIONS

This application is a continuation-in-part of Int'l Appl. No. PCT/US2008/059894, filed Apr. 10, 2008, which designates the U.S. and is incorporated herein in its entirety by reference, and which claims the benefit of U.S. Prov. Appl. No. 60/911,561, filed Apr. 13, 2007, U.S. Prov. Appl. No. 60/982,860, filed Oct. 26, 2007, and U.S. Prov. Appl. No. 60/990,795, filed Nov. 28, 2007.

FIELD OF THE INVENTION

The present invention relates generally to interlocking spatial components, and more particularly to spatial components having mating surfaces of uniform periodical structure comprising a regular array of self-interlocking connectors of the same shape allowing components to be arbitrarily interlocked along various relative directions, in various relative orientations, and upon various sides and assembled with one another to create spatial structures.

BACKGROUND

Various interlocking construction-component systems are available. Typical existing systems include components such as beams, panels or blocks that have interlockable male and female features defined along engagement surfaces allowing the components to be removably connected to one another in one or more relative configurations. For example, different types of lap and splice joints or notches may be used for assembling beams, and finger or dovetail joints may be used for interconnection of panels. However, such interconnecting structures have numerous constraints and other limitation and structural weaknesses. For example, a problem for tongue-in-groove joints is that side loading stress is concentrated in small areas around tongues, and the tongues or grooves may be deformed or even broken due large side loading. Such joints also tend to separate under vertical loading, because of small area of surface of tongues.

Particularly popular interlocking block systems are available as LEGO® playsets having rectangular blocks that engage each other in layers to form various desired shapes and structures. A typical LEGO® block has an array of studs protruding from a top side and array of receptacles, defined along a bottom side, sized to snugly receive the studs of other blocks in mating fashion. LEGO® blocks permit interlocking engagement between blocks in adjacent layers, but do not provide, for example, for side-by-side engagement between blocks within any particular layer.

PixelBlocks®, as illustrated and described in U.S. Pat. No. 5,853,314 to Bora, provide interlocking engagements between lateral faces orthogonal to the top and bottom faces of adjacent blocks. A lateral sliding dovetail male feature projects from a first lateral face and a corresponding lateral sliding dovetail female feature is recessed into a second lateral face. The lateral male and female features of one block engage respectively with female and male lateral features of another block to achieve interlocking connection of the blocks within a layer of blocks. The geometries are different for top, bottom and lateral faces, and so PixelBlocks® do not appear to permit engagement between arbitrary faces.

Stickle Bricks™ of Hasbro Inc. are interlocking blocks having brushes of flexible fingers on one or more faces of each block. The faces of two Stickle Bricks™ can be interlocked, but opposite faces of bricks are different. For example, top and bottom faces have different numbers of fingers, and, correspondingly, bricks can't be mated by top faces without displacement. Also some side faces can't be mated at all. Due to the long fingers and the small area of contact, the interconnections are unsteady and not precise, assembled constructions have large holes, and the pattern of fingers is often broken at edges and joints. Thus, Stickle Bricks are limited to use for simple construction with only a few elements and for toddlers.

Another example of interlocking blocks is one-sided Endura-Form™ panels that combine explicit tongues and grooves in one face of the panels. Compared to Stickle Bricks, Endura-Form™ panels may provide stronger connections without displacement, but require precise alignment of features for interlocking. And sides of Endura-Forms™ that do not include the tongues and grooves cannot mate with another side. The geometry of the panels limited their usage for simple flat assemblies, such as roads and pads. And the panels are susceptible to integrity issue related to side loading of tongue-and-groove connections.

Accordingly, improved spatial components are desired to provide uniform mating surfaces, and simple and variable attachment and detachment along various relative directions, in various relative orientations, and upon various sides for assembling arbitrary spatial structures.

SUMMARY

In light of the foregoing background, embodiments of the present invention provide interlocking construction components having the same, uniform, and periodical structures of mating elements along their surfaces.

Another objective of the present invention is to provide a set of simple basic components having such surfaces that can be removably interlocked to create spatial structures in a variety of different shapes.

A further objective of the present invention is to provide spatial components that can be arbitrarily joined with one another along various relative directions, in various relative orientations, and upon various sides.

A further objective of the present invention is to provide simple and fast attachments and detachments among spatial components.

A further objective of the present invention is to provide spatial components capable of demonstrating strong interlocking connections.

A further objective of the present invention is to provide spatial components having variable levels of force required for attachment and detachment.

A further objective of the present invention is to provide spatial components capable of demonstrating strong resistance to side loading.

A further objective of the present invention is to provide spatial components having reduced weight and production costs.

A further objective of the present invention is to provide safe spatial components relatively free of sharp edges and corners.

In general, these objectives are achieved by inventive spatial components having mating surfaces of uniform periodical structure comprising a regular array of self-interlocking connectors of the same shape. These components may be arbitrary mated in a mating direction perpendicular to a mating plane. To help differentiate connectors of the present invention from conventional connectors, connectors of the present invention are referred to herein as connexors. And mating surfaces of the present invention are referred to herein as connexing surfaces.

One aspect of the invention relates to an article having a connexing surface defined by a mating plane and a regular array of self-interlocking connexors. An array of connexors comprises a regularly spaced planar point lattice. The distance between any two connexors is the same, and is called lattice step. The point lattice may have a square, hexagonal, or rhombic structure.

Another aspect of the invention relates to an article having connexors of the same shape. A connexor is a symmetrical, self-interlocking connector comprising an even number of alternated sectored elements having a common center. The centers of connexors are located in nodes of a regularly spaced point lattice of the mating plane. Sectored elements have two alternated forms: positive and negative. Each sectored element of a connexor is adjacent only to sectored elements of the opposite type, that is, positive sectored elements are only adjacent negative sectored elements and negative sectored elements are only adjacent positive sectored elements. In some cases, the positive form sectored elements define open spaces representing the negative form sectored elements, and the positive form sectored elements are joined to adjacent positive form sectored elements by connecting members.

Another aspect of the invention relates to connexors having mating walls perpendicular to the mating plane and providing interlocking of alternative sectors of connexors. A connexor interlocks itself by its mating walls when alternated positive and negative sectored elements are aligned. Mating walls may be shared between alternative sectors of a connexor and adjacent connexors.

Another aspect of the invention relates to connexors having a different degree of symmetry. The degree of symmetry of the connexors determines the number of possible mating interpositions of spatial components.

Another aspect of the invention relates to connexors having different surface structures. A surface of each connexor consists of elements of arbitrary geometrical shapes, including, for example, planar, cylindrical, and spherical surface elements, parts of surfaces of rotation, and a sweep.

Another aspect of the invention relates to connexors comprising facet elements, such as to simplify interconnections and/or smooth sharp edges and corners.

Another aspect of the invention relates to connexors comprising additional locking features, such as to increase the strength of an assembly and/or prevent unintentional detachments of components.

Another aspect of the invention relates to an assembly that includes at least two articles having connexing surfaces. The connexing surfaces of articles are defined by essentially identically shaped and dimensioned lattices and connexors. Articles may be mated one to another with different displacements and orientations depending on the shapes of the cells and the connexors. Essentially no space may be defined between articles in the area of contact of the articles.

Another aspect of the invention relates to interlocking components having one connexing surface and to assemblies defining two layers of flat construction.

Another aspect of the invention relates to flat interlocking components having alternating connexing surfaces with coinciding mating planes, but opposite mating directions at both sides of tiles and 2-layered assemblies from such tiles defining locked flat constructions, in which inner tiles cannot be removed from the assemblies.

Another aspect of the invention relates to assemblies and connexing components being thin curvilinear surface-aligned tiles with connexing parts at one side of the tiles. An assembly of such connexing tiles may represent a surface of arbitrary shape.

Another aspect of the invention relates to interlocking components having two parallel, aligned connexing surfaces and to assemblies of such interlocking components defining multi-layered constructions.

Another aspect of the invention relates to minimal interlocking tiles having two parallel, aligned connexing surfaces and interlocked by several tiles from adjacent layers, and to assemblies of such tiles defining multi-layered constructions.

Another aspect of the invention relates to assemblies and interlocking components being prismatic bodies with connexing side faces. Edges of side faces may be aligned along edges of a connexor lattice.

Another aspect of the invention relates to assemblies and interlocking components being rectangular spatial blocks with connexing faces. Edges of blocks may be aligned along edges of a connexor lattice. Dimensions of blocks may directly correspond to the number and lattice step. The connexing faces of blocks may be defined by essentially identically shaped and dimensioned lattices and connexors.

Another aspect of the invention relates to assemblies and connexing blocks having different numbers of connexing faces and dimensions, especially to connexing blocks having one or more dimensions equal to a unit lattice step, such as nodes, bricks, beams, and panels.

Various characteristics, as well as additional details, of the present invention are further described herein with reference to these and other embodiments.

BRIEF DESCRIPTION OF THE DRAWINGS

Figure 1:
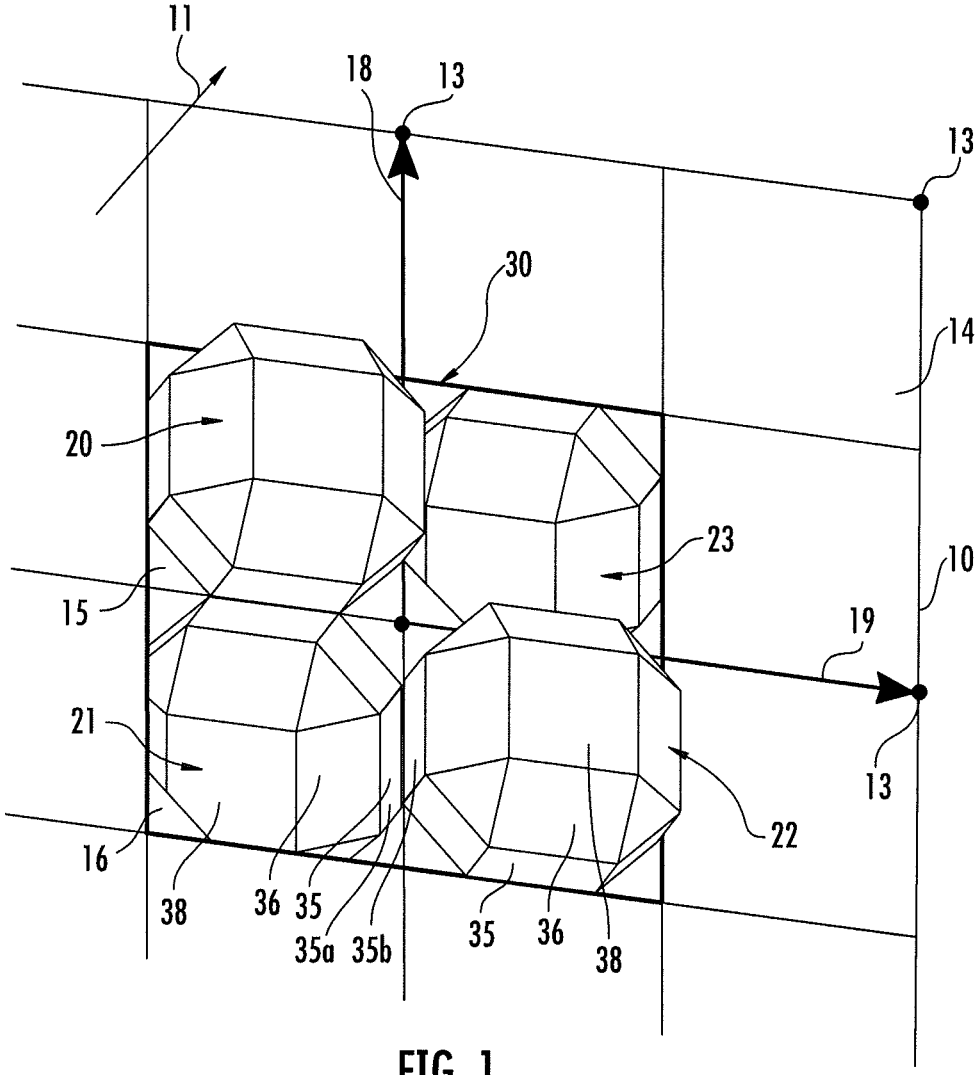
Figure 8:
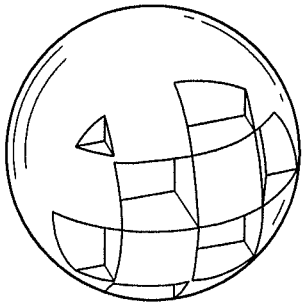
Figure 9A:
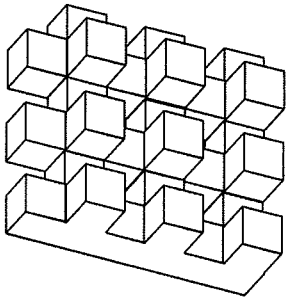
Figure 9B:
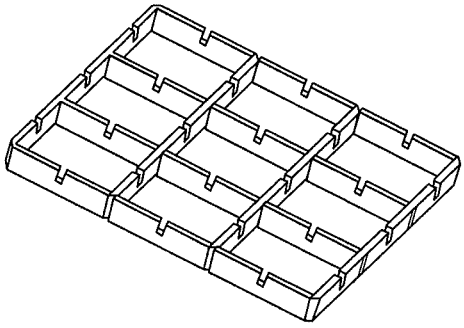
Figure 9C:
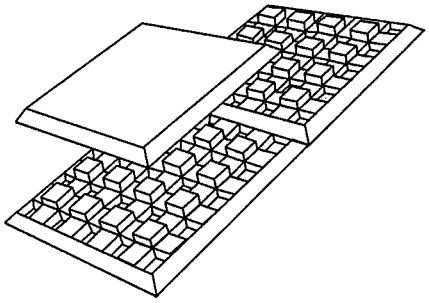
Figure 9D:
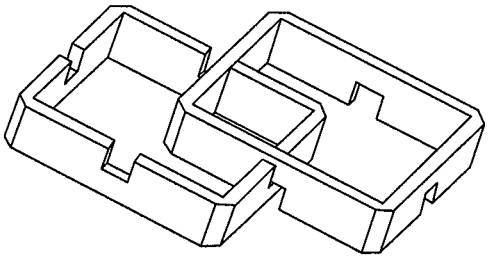
Figure 9E:
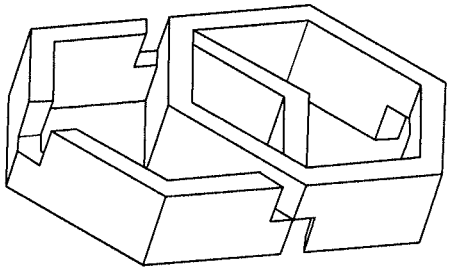
Figure 9F:
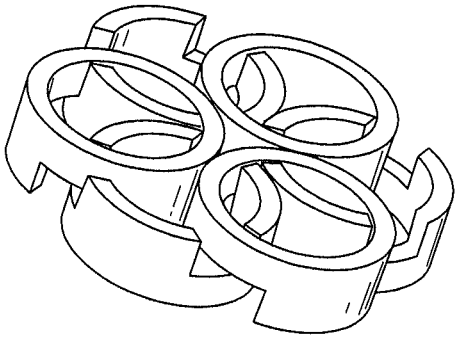
Figure 9G:
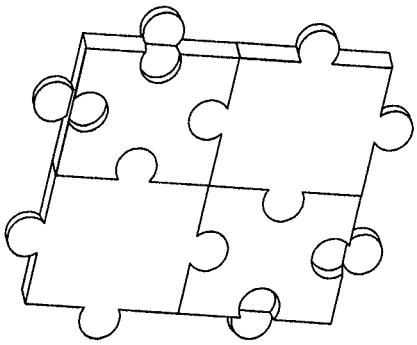
Figure 9H:
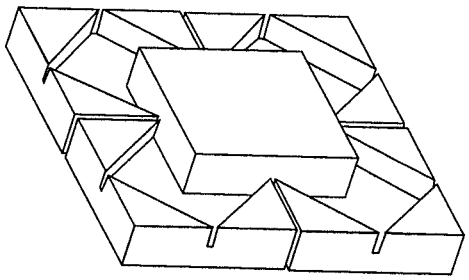
Figure 9I:
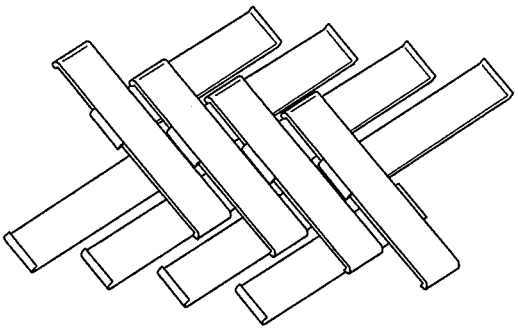
Figure 10A:
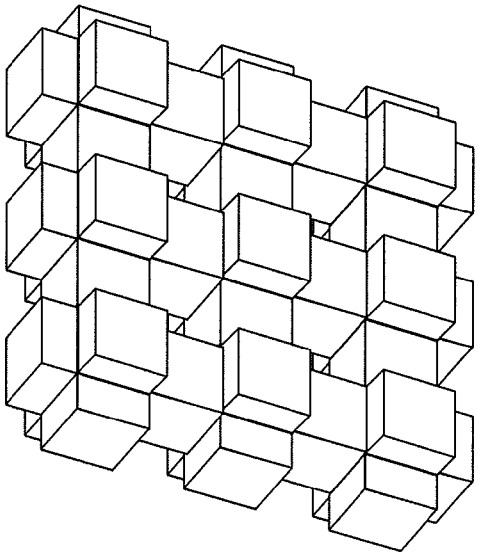
Figure 10B:
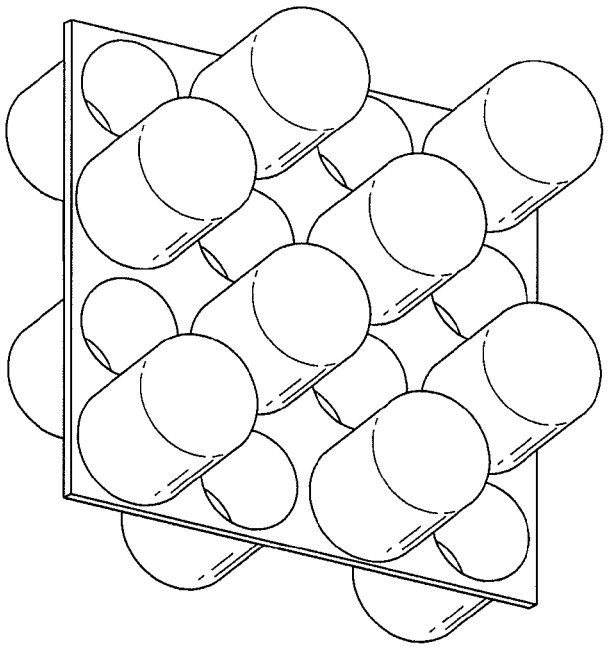
Figure 11A:
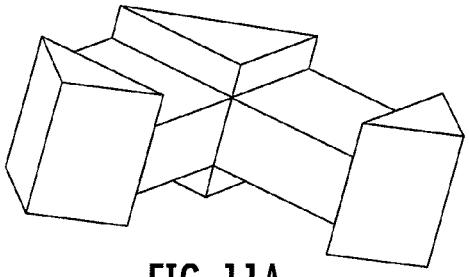
Figure 11B:
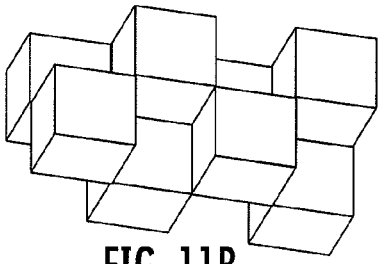
Figure 11C:
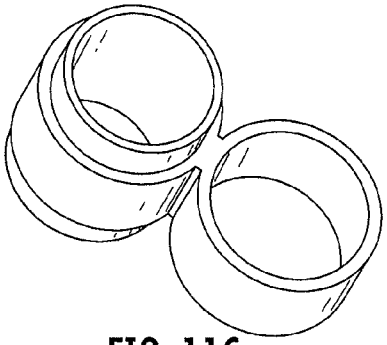
Figure 11D:
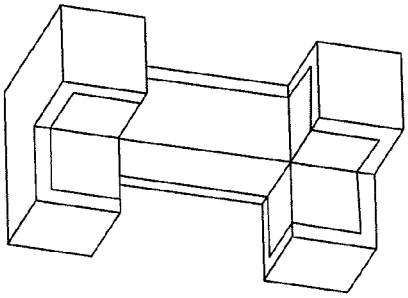
Figure 11E:
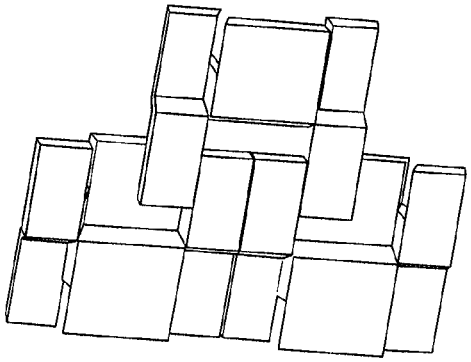
Figure 11F:
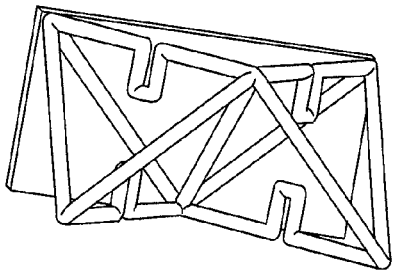
Figure 11G:
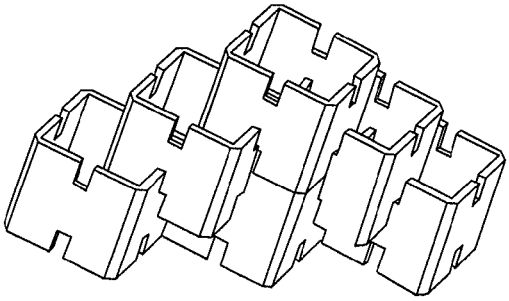
Figure 11H:
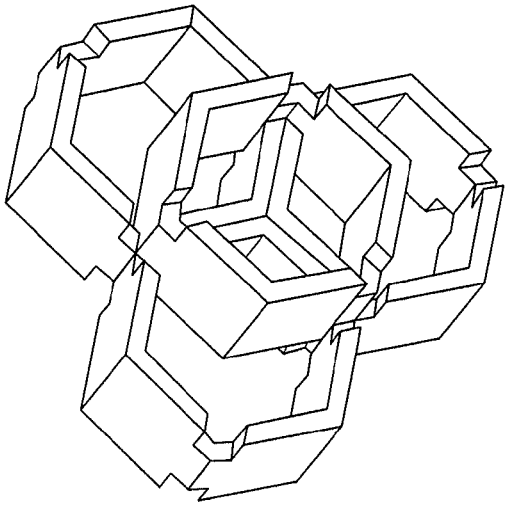
Figure 12:
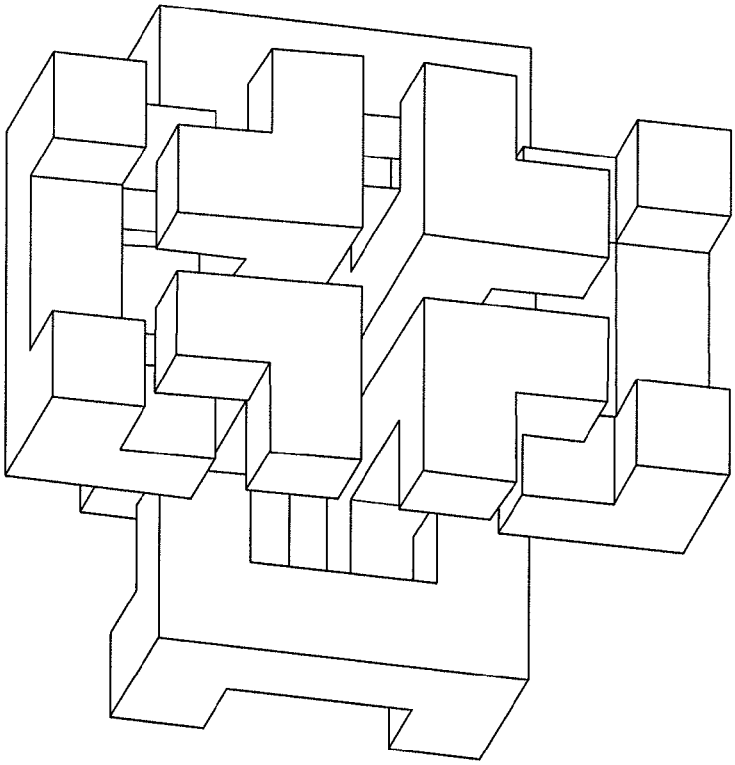
Figure 13A:
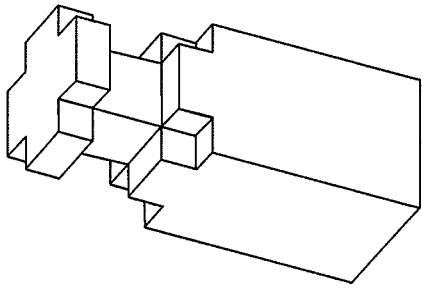
Figure 13B:
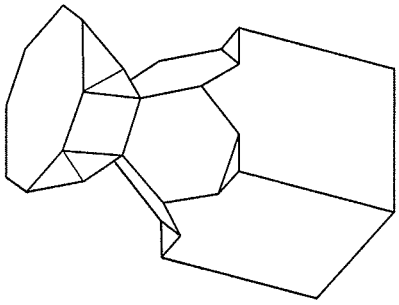
Figure 13C:
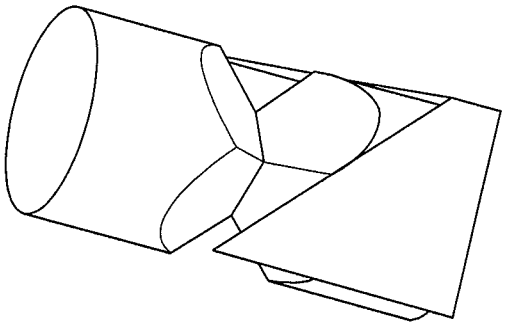
Figure 17A:
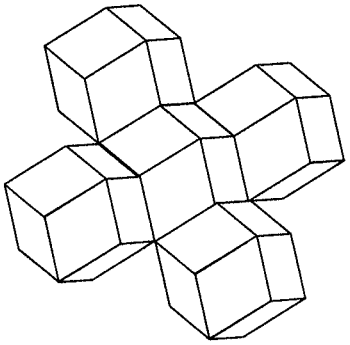
Figure 17B:
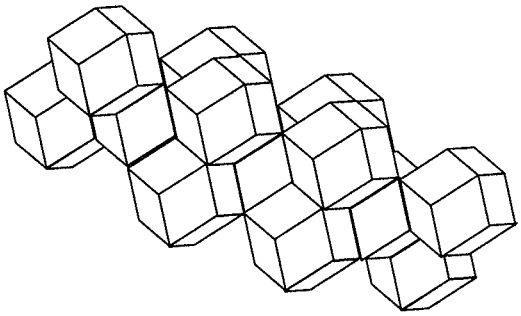
Figure 18A:
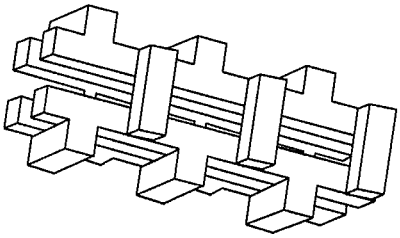
Figure 18B:
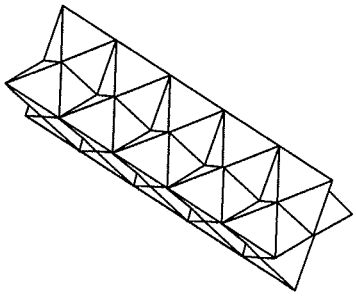
Figure 19:
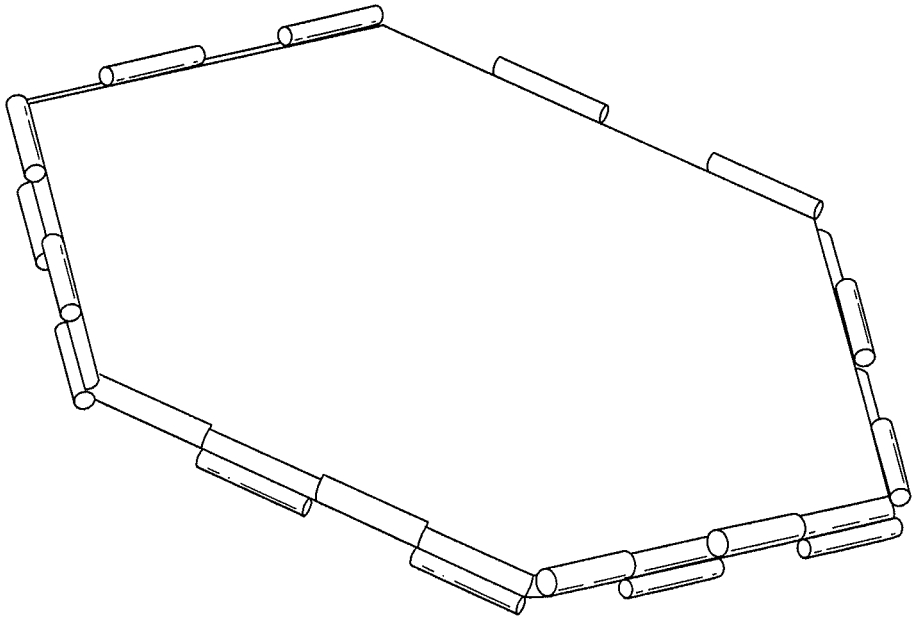
Figure 20:
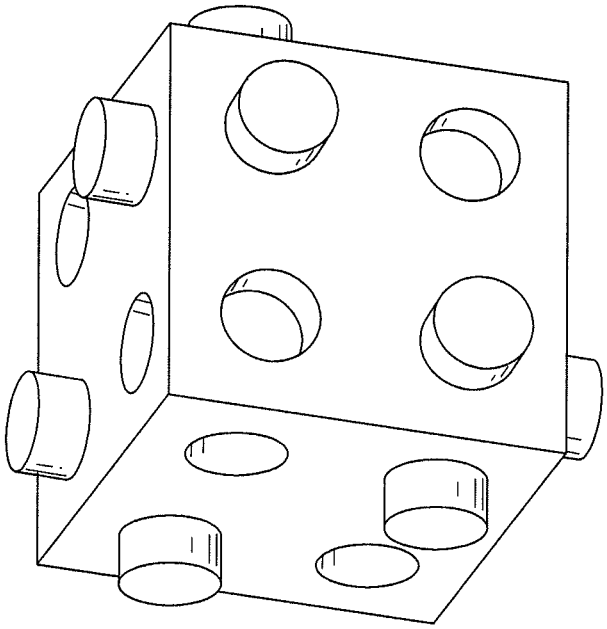
Figure 21:
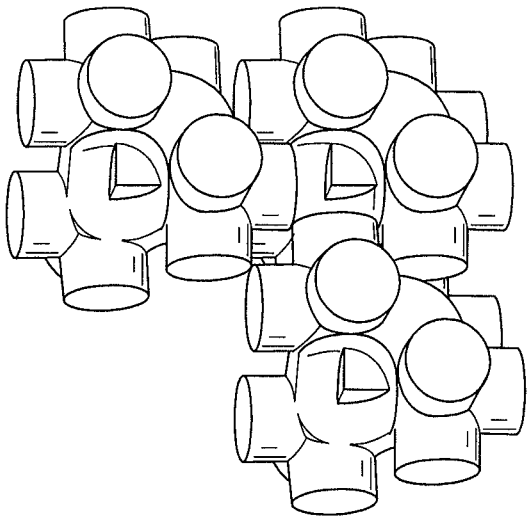
Figure 22:
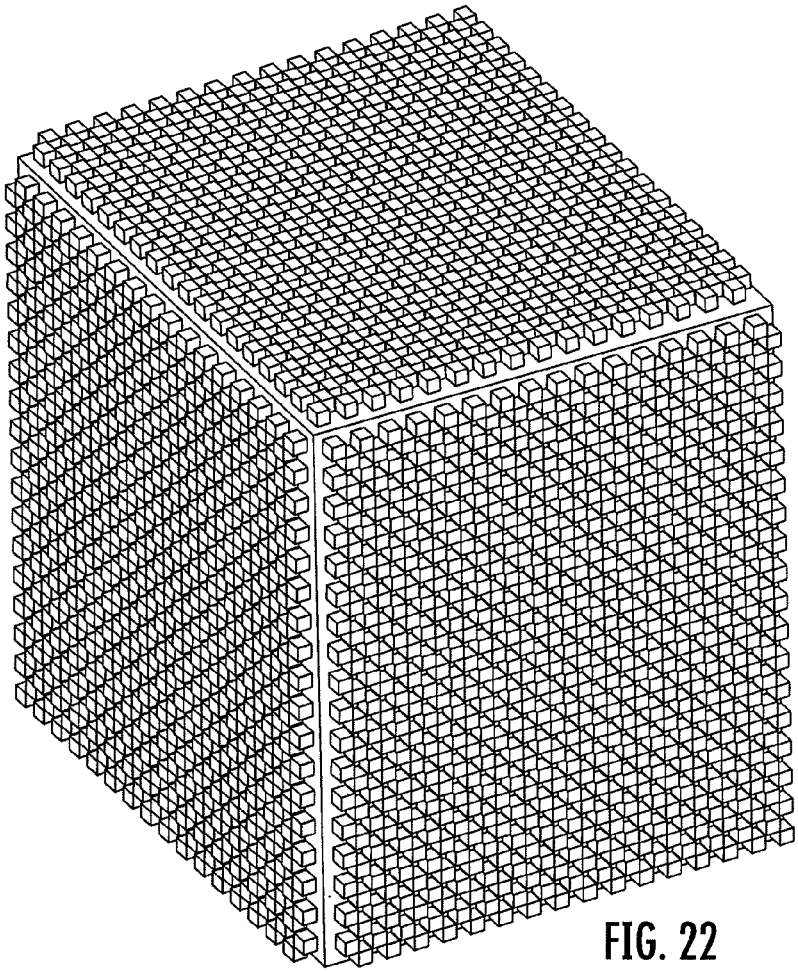
Figure 23:
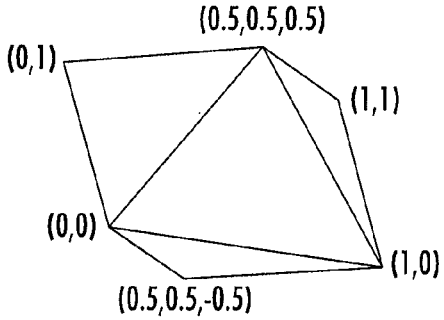
Figure 24A:
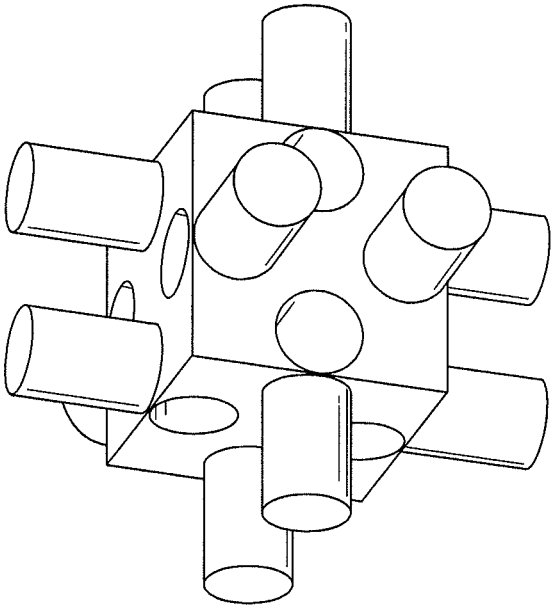
Figure 24B:
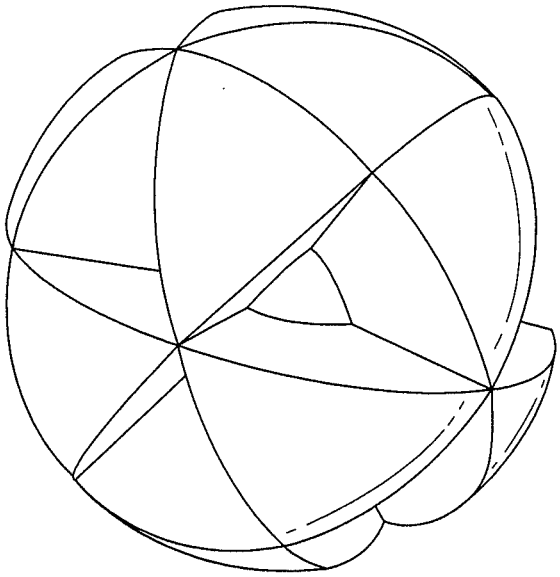
Figure 25A:
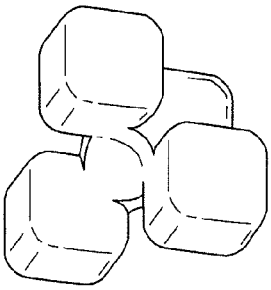
Figure 25B:
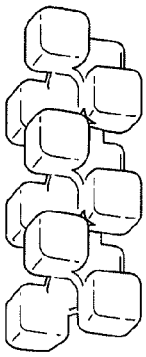
Figure 25C:
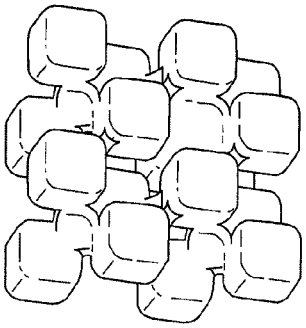
Figure 26A:
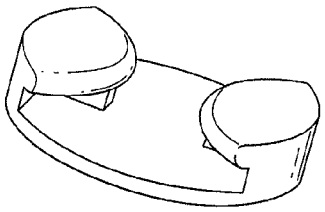
Figure 26B:
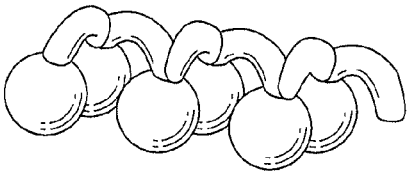
Figure 26C:
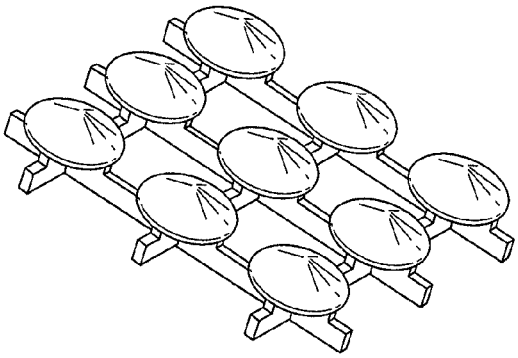
Figure 27A:
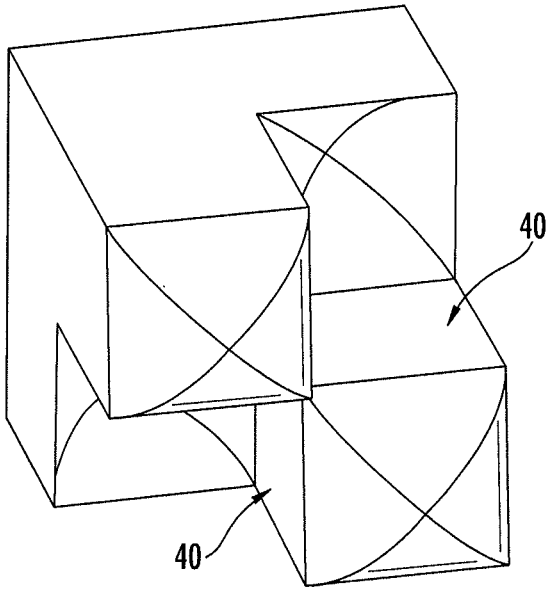
Figure 27B:
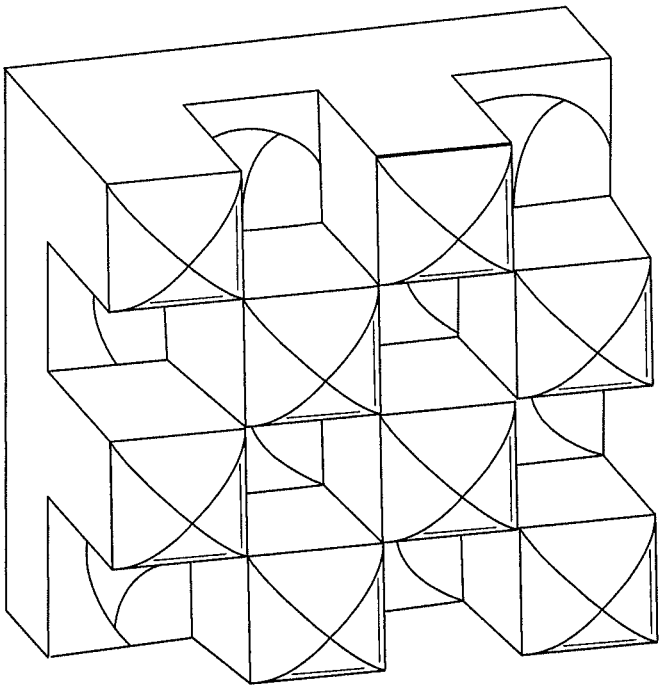
Figure 28A:
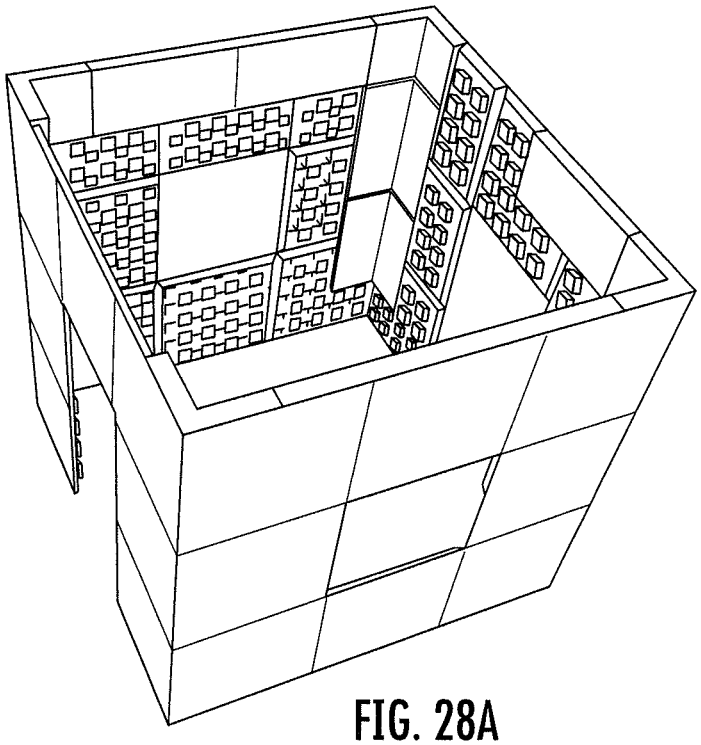
Figure 28B:
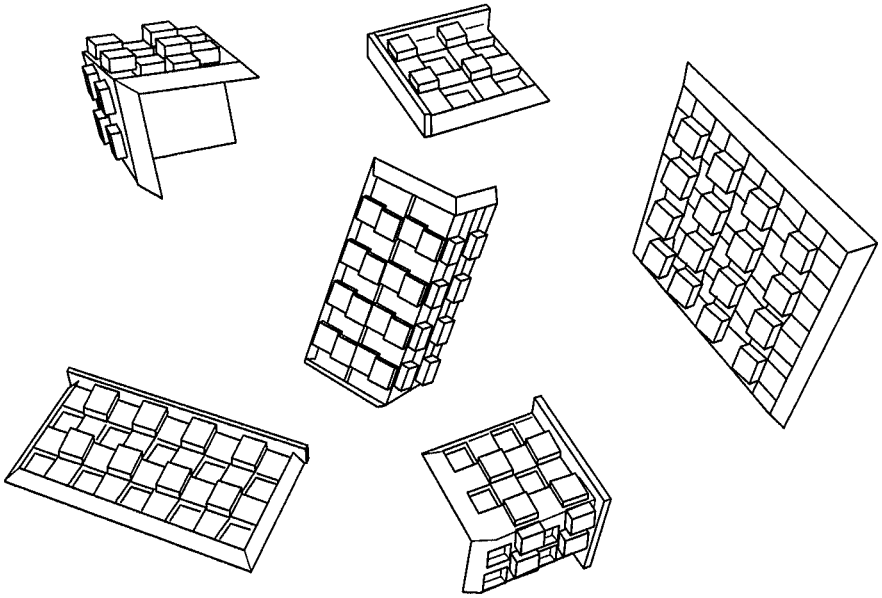
Figure 28C:
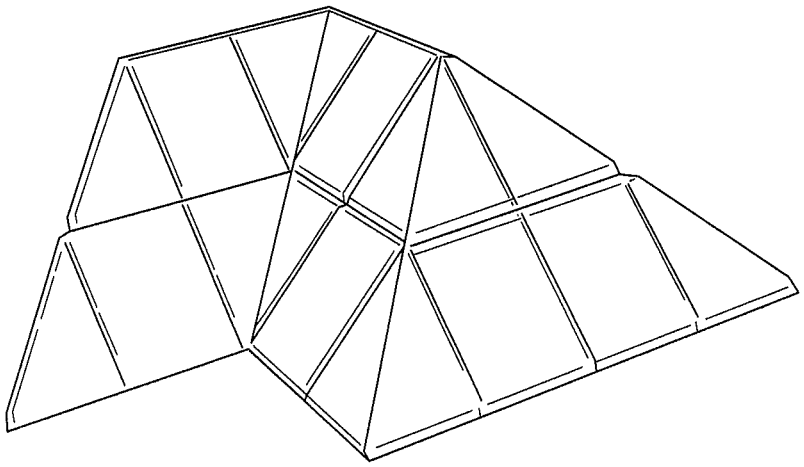
Figure 28D:
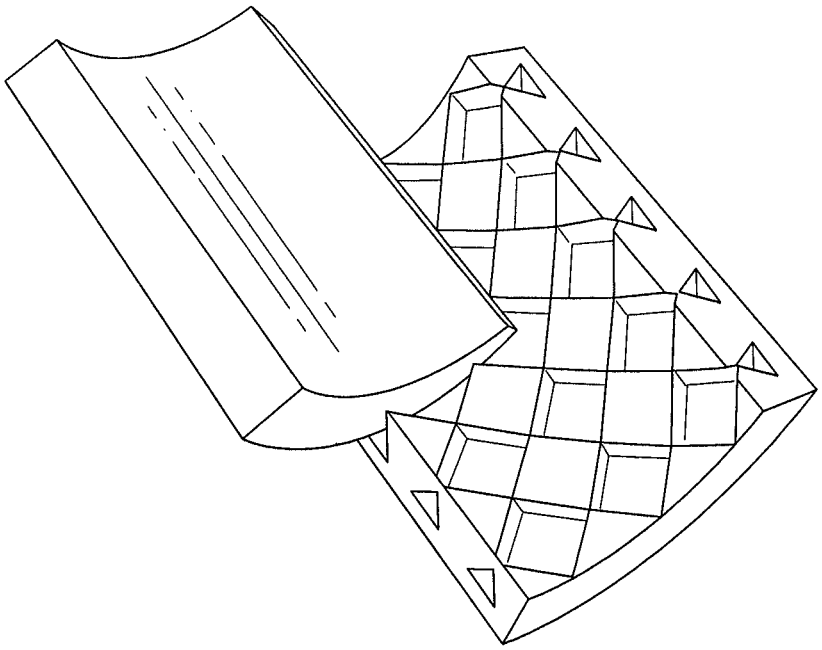
Figure 29A:
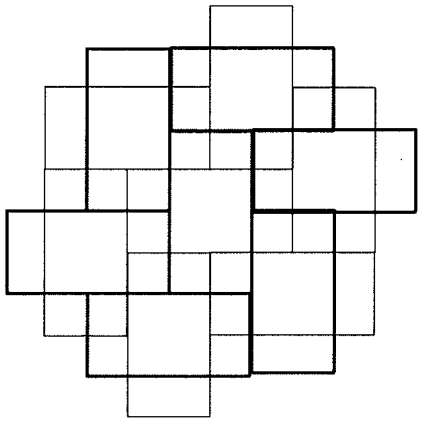
Figure 29B:
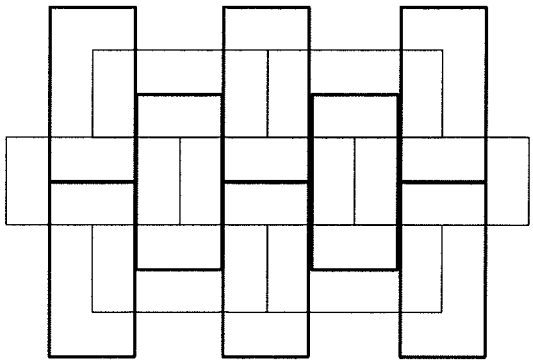
Figure 30:
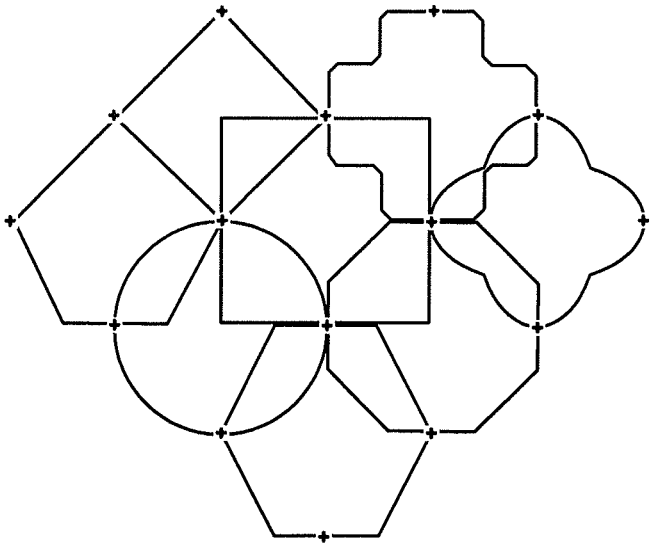
Figure 31:
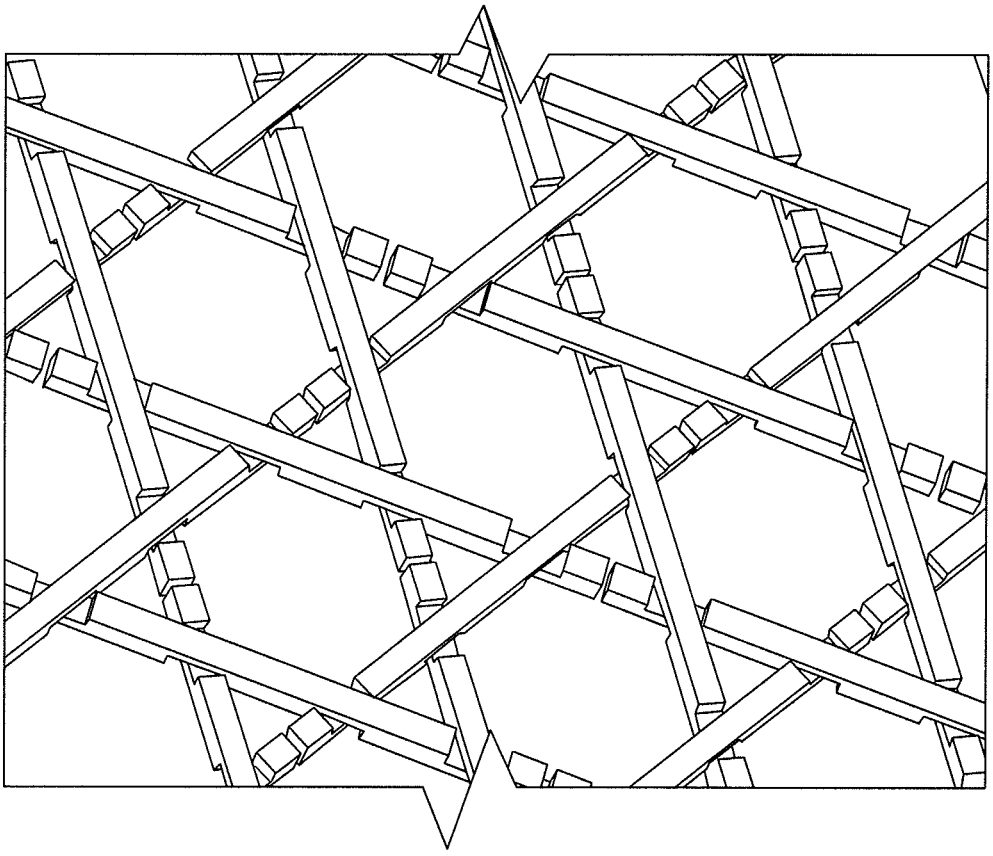
Figure 32A:
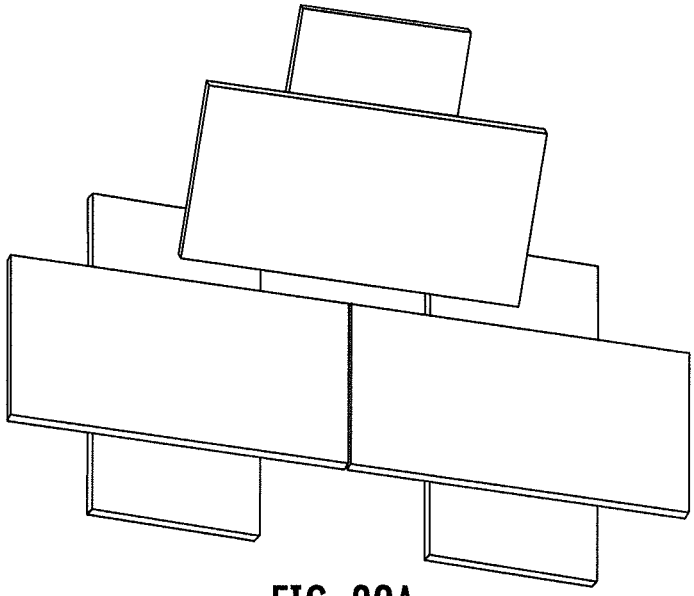
Figure 32B:
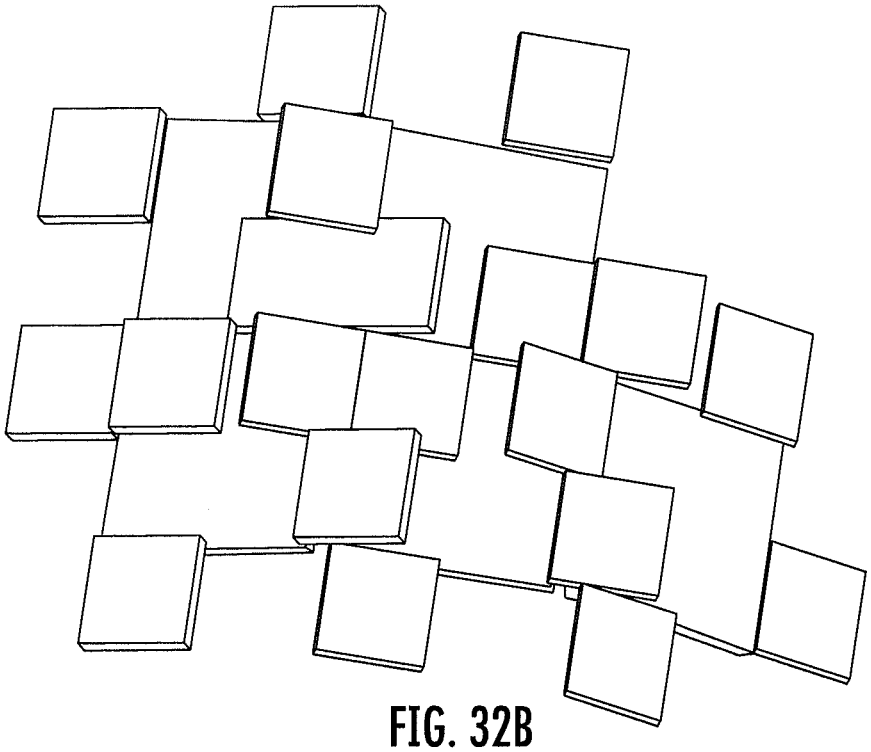
Figure 33:
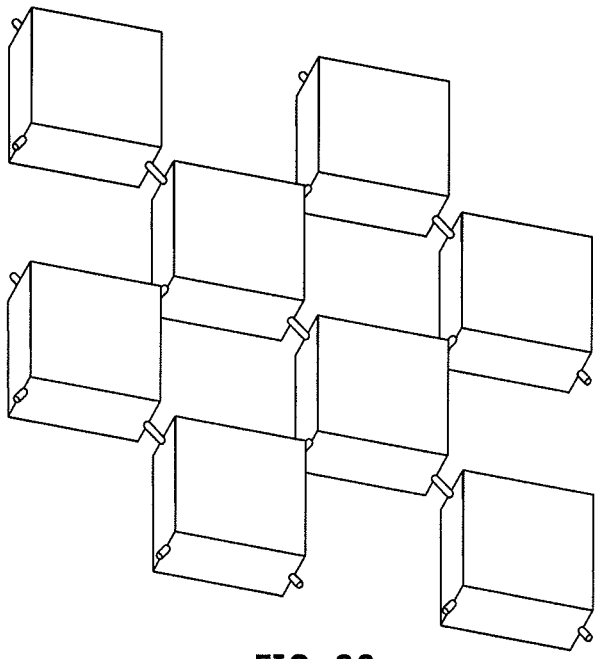
Figure 34:
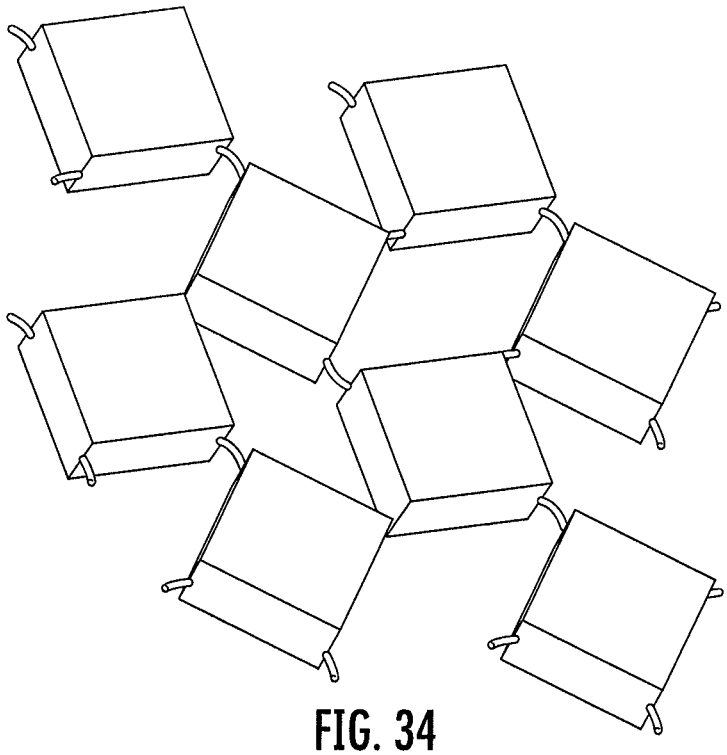
Figure 35:
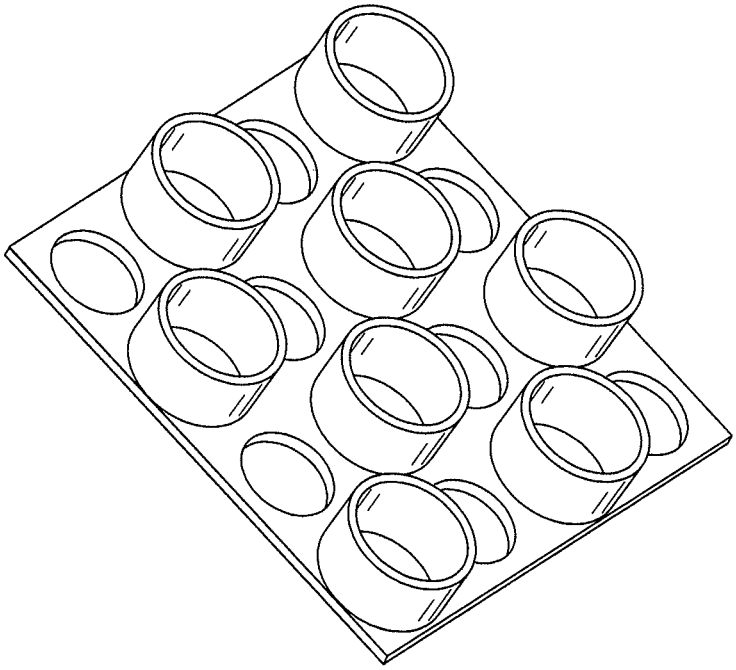
Figure 36:
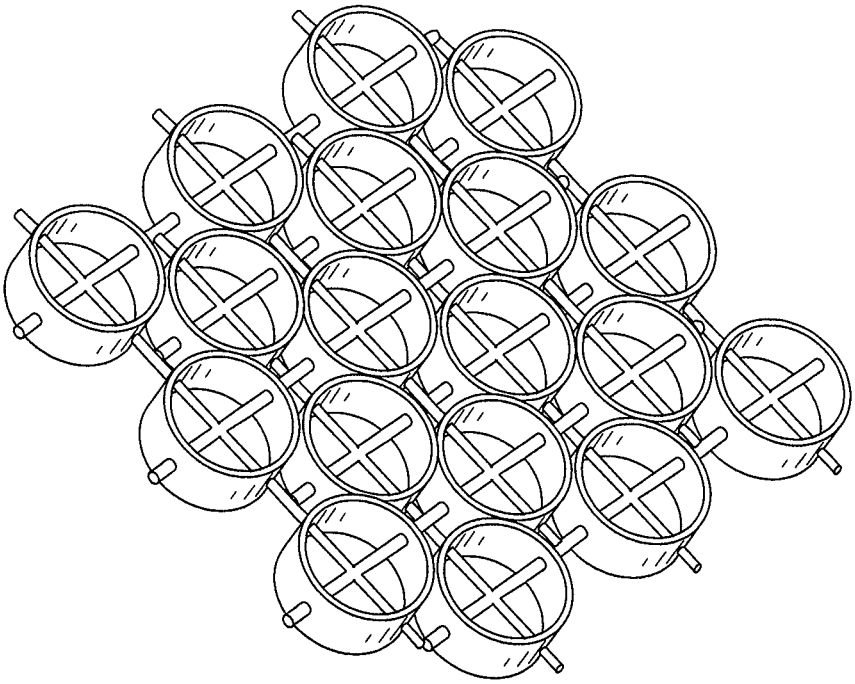

Having thus described the invention in general terms, reference will now be made to the accompanying drawings, which are not necessarily drawn to scale, and wherein:

FIG. 1 illustrates a mating plane, a mating direction, a connexor having four sector elements (two positive and two negative), as well as other features of connexors according to embodiments of the present invention;

FIGS. 2*a*.1-2*f*.2 illustrate different embodiments according to the present invention of convex polygonal connexors and their sector surfaces;

FIGS. 3*a*.1-3*f*.2 illustrate different embodiments of non-polygonal connexors and their sector surfaces;

FIGS. 4*a*-4*f* illustrate different embodiments according to the present invention of 1-, 2- and 4-fold symmetrical connexors;

FIGS. 5*a*-5*f* illustrate different embodiments according to the present invention of non-convex and hollow connexors;

FIGS. 6*a*-6*b* illustrate an embodiment according to the present invention of a connexor with curvilinear border between sectors and its sector surface;

FIGS. 7*a*.1-7*d*.2 illustrate different embodiments according to the present invention of connexors for hexagonal planar point lattice and their sector surfaces;

FIG. 8 illustrates a sphere having a connexing part of its surface in accordance with an embodiment of the present invention;

FIG. 9*a* illustrates an embodiment according to the present invention of a one-sided connexing panel with prismatic connexors having a height of one unit;

FIG. 9*b* illustrates an embodiment according to the present invention of a one-sided connexing hollow grid;

FIG. 9*c* illustrates an embodiment according to the present invention of an assembly of three one-sided connexing partially overlaying panels;

FIG. 9*d* illustrates an embodiment according to the present invention of an assembly of two one-sided minimal square tiles;

FIG. 9*e* illustrates an embodiment according to the present invention of an assembly of two one-sided hexagonal tiles;

FIG. 9*f* illustrates an embodiment according to the present invention of an assembly of two one-sided cylindrical tiles;

FIG. 9*g* illustrates an embodiment according to the present invention of an assembly of square panels with 1-fold locking connexors;

FIG. 9*h* illustrates an embodiment according to the present invention of a 2-layered assembly of square panels;

FIG. 9*i* illustrates an embodiment according to the present invention of a 2-layered assembly of crisscrossed elongated tiles;

FIG. 10*a* illustrates an embodiment according to the present invention of a two-sided connexing panel with prismatic connexors and same signs of opposite sectors;

FIG. 10*b* illustrates an embodiment according to the present invention of a two-sided connexing thin foil panel having different signs of opposite sectors;

FIGS. 11*a*-11*f* illustrate different embodiments according to the present invention of connexing bricks;

FIGS. 11*g*-11*h* illustrate different embodiments according to the present invention of assemblies of hollow connexing tiles;

FIG. 12 illustrates an embodiment according to the present invention of an assembly of a cube formed from 8 identical brick elements;

FIGS. 13*a*-13*c* illustrate different embodiments according to the present invention of timber and log connexing notches;

FIGS. 14*a*-14*d* illustrate embodiments according to the present invention of side connexing panels with cylindrical connexors and embodiments according to the present invention of different assemblies formed from such panels;

FIGS. 15*a*-15*d* illustrate different embodiments according to the present invention of prismatic 4-sided connexing nodes;

FIGS. 16*a*-16*e* illustrate embodiments according to the present invention of 2-layered assemblies of alternating prismatic tiles;

FIGS. 16*f*-16*j* illustrate embodiments according to the present invention of 2-layered assemblies of alternating crisscrossed elongated tiles;

FIG. 17*a* illustrates an embodiment according to the present invention of a 4-sided 5-cell connexing node;

FIG. 17*b* illustrates an embodiment according to the present invention of a beam with alternated rhombic dodecahedron connexors;

FIGS. 18*a*-18*b* illustrate different embodiments according to the present invention of 4-sided connexing beams;

FIG. 19 illustrates an embodiment according to the present invention of a side-connexing polygonal panel with cylindrical connexors;

FIG. 20 illustrates an embodiment according to the present invention of a 6-sided connexing block;

FIG. 21 illustrates an insertion issue of an embodiment according to the present invention of 6-sided axial aligned connexing blocks;

FIG. 22 illustrates an embodiment according to the present invention of a 6-sided connexing block with partially removed edge cells;

FIG. 23 illustrates an octahedron defining an embodiment of a axial aligned connexor surface according to the present invention;

FIGS. 24*a*-24*b* illustrate different embodiments according to the present invention of 6-sided connexing nodes with diagonally aligned connexors;

FIG. 25*a* illustrates an embodiment according to the present invention of a 6-sided connexing node;

FIG. 25*b* illustrates an embodiment according to the present invention of a 6-sided connexing beam;

FIG. 25*c* illustrates an embodiment according to the present invention of a 6-sided connexing panel;

FIG. 26*a* illustrates an embodiment according to the present invention of a snap button fastener;

FIG. 26*b* illustrates an embodiment according to the present invention of a linear fastener;

FIG. 26*c* illustrates an embodiment according to the present invention of a area fastener;

FIGS. 27*a*-27*b* illustrate embodiments according to the present invention of 4- and multi-wire electrical connectors;

FIG. 28*a* illustrates an embodiment according to the present invention of an assembly of surface-aligned connexing tiles;

FIG. 28*b* illustrates an embodiment according to the present invention of a set of surface-aligned connexing tiles for construction of square cellular structures;

FIG. 28*c* illustrates an embodiment according to the present invention of a roof assembly of triangular surface-aligned connexing tiles;

FIG. 28*d* illustrates an embodiment according to the present invention of a cylindrical surface-aligned connexing tiles;

FIGS. 29*a*-29*b* illustrate embodiments according to the present invention of 2-layered assemblies of crisscrossed elongated tiles;

FIG. 30 illustrates an embodiment according to the present invention of an assembly of hollow prismatic tiles of different shapes with the same lattice of slots;

FIG. 31 illustrates an embodiment according to the present invention of an assembly of triaxial hexagonal weave;

FIGS. 32*a*-32*b* illustrate different embodiments according to the present invention of assemblies of prismatic 4-sided connexing nodes;

FIG. 33 illustrates an embodiment according to the present invention of an assembly of square tiles connected by connecting members configured to mate with an assembly of square tiles;

FIG. 34 an embodiment according to the present invention of an assembly of square tiles connected by flexible connecting members;

FIG. 35 illustrates an embodiment according to the present invention of an assembly of a male connexing surface in which the negative sectored elements define a void; and FIG. 36 illustrates an embodiment according to the present invention of an assembly of two flexible connexing surfaces to form a rigid article.

DETAILED DESCRIPTION

The present invention is described in further detail in the following with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

While an exemplary use of the present invention relates to the field of construction pieces or elements, it will be appreciated from the following description that the invention is also useful for many types of products in which interconnections between parts are desired including. For example, the present invention relates to children toys, garments, furniture, shelters, temporary constructions, other consumer and industrial objects, and combinations of objects. One of ordinary skill in the art will recognize that, while the present invention is particularly useful for consumer and industrial products and constructions, the present invention can be used for education and artistic expression.

A basic and exemplary structural framework for embodiments of connexing surfaces of the present invention is illustrated in FIG. 1. It is defined by the square point lattice 12 in the implicit mating plane 10 with nodes 13. The lattice is defined by the origin and two orthogonal unit basic vectors 18 and 19. Cells 14, 15, 16 of square lattice 12 are unit squares. A direction 11 perpendicular to the mating plane 10 is referenced herein as the mating direction. Different planar lattices may be used with different embodiments of the present invention. A preferred type of lattice is a regularly spaced lattice defined by two unit basic vectors, which may have different shapes of cells and may be square if basic vectors are orthogonal, hexagonal if the angle between basic vectors is 60 degrees, or rhombic in other cases, as shown and described herein.

A basic element and building block of the present invention is a connexor. A connexor is typically a continuous surface element with a closed border. To fulfill objectives of the invention, connexors have the same or essentially the same shape and dimensions for all mating surfaces. A connexor may be rotationally symmetrical and may have a different degree of rotational symmetry with respect to the mating direction. A connexor is constructed from an even number of sectors that alternate each other, such as sectors 20, 21, 22, 23 of sectored parts 35, 36, 38. Sectors have two alternate forms: positive 20, 22 forms in positive cells 15 and negative 21, 23 forms in negative cells 16. A negative sector 21, 23 is an inverted positive sector 20, 22. The line of inversion may be one of 4 axes of symmetry of a square or one of 3 axes of symmetry of a triangle. Alternated sectors of connexors interlock each other, such as positive sector form 20 of positive cell 15 and negative sector form 21 of negative cell 16. Any rotationally symmetrical surface with an even number of alternated sectors having the same or essentially the same shapes and dimensions may be used as the surface of a sectored connexor. Depending on selection of sector borders, there exist two preferred forms of alignment of connexors: axial and diagonal. A generic connexor structure may be considered as a further development of known timber cross halved joint or saddle joint.

An arbitrary embodiment of the interlocking surface of the present invention is composed from an array of connexors placed into a regular lattice and rotated to some angle to provide a complete interlocking mating surface. The resulting connexing surface 30 represents a basic embodiment of a mating surface of a component of the present invention illustrated in FIG. 1.

Four sectors 20, 21, 22, 23 joined together in alternating order define a connexor of the connexing surface 30. Positive sectors 20, 22 are coupled with negative sectors 21, 23. Shapes and all dimensions of sectors are all the same or essentially the same. If two such connexing surfaces 30 are joined together, corresponding alternative sectors fit one another and the surfaces will engage each other. Thus, two objects each having such a connexing surface will interconnect each one into the other.

In some cases, the positive sectors 20, 22 are configured to define open spaces representing the negative sectors 21, 23 (e.g., the negative sector is a void), as shown in FIGS. 33-36. In FIG. 33, for example, square tiles are connected by connecting members 50, such as rods, cables, wires, or pins, and define square voids that serve as the negative sectors 21, 23. Thus, the connecting members may be flexible in some embodiments to provide a degree of flexibility to the connexing surface 30. As a result, the connexing surface 30 itself may be deformed, folded, rolled and/or easily cut to a desired shape, as illustrated at FIG. 34. The positive sectors 20', 22' (not shown) of a mating connexing surface 30' (not shown) can then be mated with the negative sectors 21, 23 to form a structure with limited flexibility, such as a rigid structure. In the example illustrated in FIG. 33, a mating connexing surface 30' (not shown) can be identical to the connexing surface 30.

The connexing structures can include positive and negative sectors having other shapes, as well, such as hexagonal and triangular tiles and voids, and the structures may be configured such that more than two connexing structures may be needed to assemble the rigid structure. In FIGS. 35 and 36, for example, circular shapes are used to define the sectors. In FIG. 35, positive sectors are defined by cylindrical male elements 52, whereas the space between the cylindrical male elements 52 (i.e., the absence of the cylindrical male elements 52) form the negative sectors. The connecting members, in this case, form a sheet 53 in the mating plane extending between adjacent positive form sectored element. Thus, mating cylindrical male elements 52' (not shown) from a mating connexing surface 30' (not shown) are configured to fit between the cylindrical male elements 52 to form the assembled structure. The cylindrical male elements 52 may be integrally formed with or attached to the sheet 53 to form the connexing structure. The sheet 53 and/or the cylindrical male elements 52 may be rigid or flexible and have through holes in the negative and positive sectors to reduce the weight and to provide easy disassembly and access through the assembly, such as for air and/or fluid flow, grass roots or other vegetation, or access for piping, cabling, and/or conduits.

Another example of a structure with circular positive sectors is shown in FIG. 36, which illustrates the assembly of two connexing surfaces 30, 30'. The assembly of circular positive sectors 20, 22 in this case may be connected by rods 54, which may be flexible or rigid. The structure may be assembled into rigid constructions and disassembled into flexible components, such as for on-site permanent or temporary construction assembly and disassembly.

Referring again to FIG. 1, to provide interlocking of two connexing surfaces, a connexing surface 30 includes mating walls 35 of sectors, and may also include sector parts that are not defined geometrically as distinct features of a connexor, such as grooves. Mating walls 35 are orthogonal to the mating plane 10 alone direction 11. Mating walls 35 prevent rotation and/or displacement of interlocked surfaces 30 in any direction but the mating direction 11. Therefore, mating walls 35 allow for interlocking of two connexing surfaces 30. Mating walls 35 may be commonly shared between adjacent sectors and cells, such as mating walls **35*a* and 35*b* in FIG. 1**.

Further, to facilitate interconnecting of two connexing surfaces, a connexing surface 30 may include facet elements 36. When two connexing surfaces approach one another, facets 36 may help to guide the surfaces for a simple and blind coupling. Facet elements 36 may also provide for smoothing sharp edges and corners of components, such as to facilitate making them more user-safe. Any number of facets and/or facets of different symmetric shapes may be added to connexors. Truncations of and by different symmetric bodies such as planes, spheres, cylinders, and cones may be used for facets of a connexor.

The structure of connexing surfaces may be also described in other terms. As mentioned above each connexor comprise an even number of alternated sectors. Accordingly, a dyad of two adjacent positive and negative sectors may be considered as a basic element for construction of connexing surfaces. In this case, a connexing surface may be considered as a union of tiled adjacent dyads of the same shape. Each dyad comprises two alternative halves that are configured to mate with each other after rotation to 180 degrees of a dyad around a diagonal, where the diagonal is a line separating a dyad into two halves. Correspondingly, after such diagonal rotation a connexing surface is configured to interlock itself, i.e., to interlock with a like connexing surface.

Another approach is to consider a connexing surface as an assembly comprising a plurality of separated adjacent tiles of the same shape. Each tile is a union of several dyads. A tile may not interlock itself to create a locked assembly, but two connexing surfaces assembled from tiles interlock one another and create a locked assembly. Several adjacent tiles from one surface assembly are locked by one tile from another surface assembly. Usually, for square lattices, four tiles are locked by one tile, and for hexagonal lattices, three tiles are locked. The objective of this invention is to describe minimal tiles providing such locked tiled assemblies and comprising a minimal number of dyads. Different examples of minimal tiles and assemblies are described further.

A connexing surface of the present invention has uniform, symmetric, periodic structure and can be arbitrary interlocked with another connexing surface having the same or essentially the same structure. An objective of this invention relates to different properties and applications of such connexing surfaces and spatial objects having such connexing surfaces. A connexing surface may limit a solid spatial body, but also may limit as a thin foil an empty volume of space of a particular shape, and also may be a wire-frame constriction.

Different geometrical shapes of connexors provide a variety of constructive properties for resulting connexing surfaces. The shape of a connexor may have more or less degree of symmetry. The number of pairs of alternated sectors determines how many identical folds a connexor has. The order of the symmetry of connexor determines a number of possible mating interpositions of two connexing surfaces.

FIGS. 2*a*.1-2*f*.2 illustrate different embodiments of connexors having polygonal surfaces for square lattices. Each of FIGS. 2*a*.1-2*f*.2 presents a particular embodiment of basic sector surface and a corresponding connexor. The cubic embodiment of FIG. 2*a*.1 is generic for many other embodiments. Different symmetric truncations of a cube may be used for sector surfaces of connexors. FIG. 2*b*.1 illustrates a vertex-truncated cubic embodiment. FIG. 2*a*.1 illustrates an edge-truncated cubic embodiment having the shape of a rhombic dodecahedron. A rhombicuboctahedron embodiment having both edge and vertex truncations was illustrated in FIG. 1. FIG. 2*d*.1 illustrates an embodiment of a connexor having sectors with 2-fold rotational symmetry.

Non-polygonal surfaces may also be used for connexor embodiments of the present invention. A non-polygonal connexors can be constructed, for example, by truncation of a unit cube by a curved symmetrical body. Spheres and cylinders are symmetrical bodies and may be selected as primary trimming objects. FIG. 3*a*.2 illustrates a cubic embodiment truncated by a sphere. FIG. 3*b*.1 illustrates a cylindrical embodiment, and FIGS. 3*c*.1 and 3*d*.1 illustrate embodiments corresponding to the intersection of two and three perpendicular cylinders, respectively. Edges of a polygonal surface of connexors may be filleted by cylinders and vertexes by spheres of the same radius. FIG. 3*e*.2 illustrates a cubic embodiment smoothed in this way. In general, any edges or corners of a connexor may be smoothly filleted such as by the surface of a rolling ball.

Another way to facilitate interconnections according to embodiments of the present invention is to consider different prismatic surfaces within a square cell. An embodiment with a cylindrical prism was presented in FIG. 3*b*.1. FIG. 2*e*.1 illustrates a reduced square prism, and FIG. 2*f*.1 illustrates an octagonal prism. Prismatic embodiments may be preferred embodiments for bodies having multiple connexing surfaces.

Figure 4A:
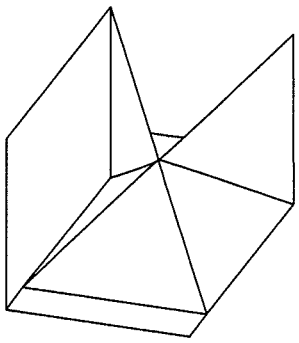
Figure 4B:
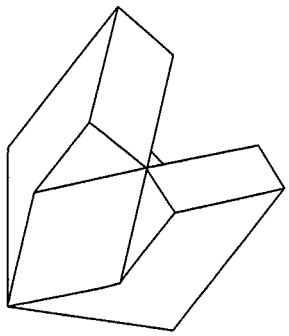
Figure 4C:
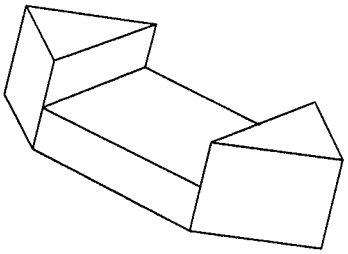
Figure 4D:
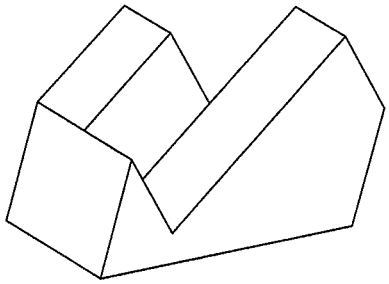
Figure 4E:
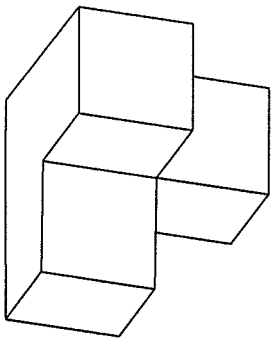
Figure 4F:
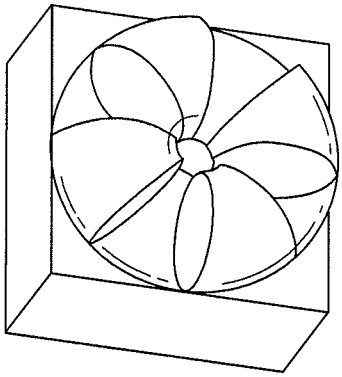

Other embodiments of connexors are illustrated in FIGS. 4*a*-4*f*. Connexors with 2-fold symmetry of diagonal and axial forms are illustrated respectively in FIGS. 4*a*-4*d*. A connexor with 1-fold symmetry is illustrated in FIG. 4*e*. A 4-fold torus connexor is illustrated in FIG. 4*f*.

Two such connexing surfaces may interlock by mating their mating walls. A force required for displacement for attachment and/or detachment of two connexing surfaces may depend on the frictional forces between the mating walls, and may correspondingly depend upon the total area of the mating walls and other mating surfaces, such as facets and extreme distal surfaces, and coefficients of friction of the substances from which the mating components are constructed or covered. By varying the areas of the mating walls and the substances from which the mating components are constructed or covered, the friction forces can be increased or reduced to respectively increase or decrease the force required for displacement for attachment and/or detachment of two connexing surfaces, such as depending on the desired use of an assembly formed by the connexing surfaces. The total area of the mating walls contributes to the detachment force. Mating surfaces of the invention provide a high density of mating elements and correspondingly a large total area of mating surfaces. This allows the interlocking articles to be constructed of less expensive materials, to be smaller, and/or to provide a better interlocking engagement. But this also may create difficulties to attach and/or detach two mating surfaces. Accordingly the connexors may have slightly different shape and/or dimensions, i.e., be essentially the same but not identically the same, to facilitate the practical, real-world mating of physical structures, thereby accounting for variances in manufacturing, alignment in the mating direction, and anticipated frictional forces.

Figure 5A:
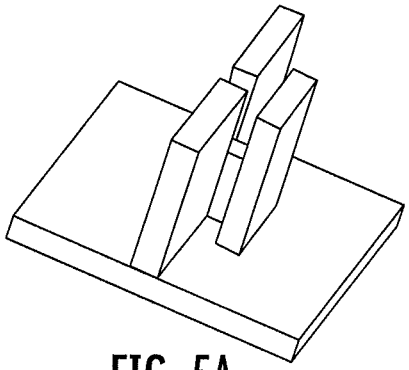
Figure 5B:
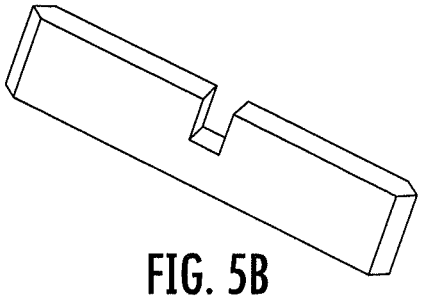
Figure 5C:
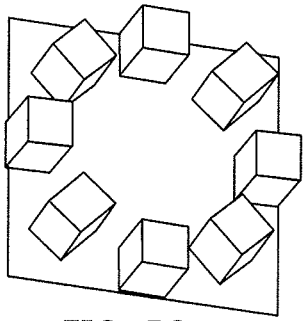
Figure 5D:
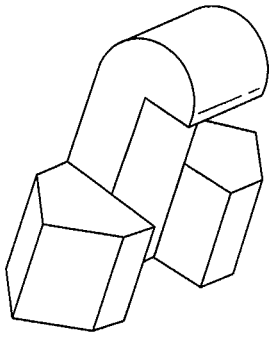

As mentioned above, the mating force depends on the frictional forces between surfaces of mating walls. In some cases, it may be necessary to change these forces or even to make a permanent interlock. For example, a convenient way to do this may be to add a mediator between the two mating surfaces. For example, glue or other hardeners can be used for permanent connections, and different powders graphite, greases, oils, or other substances may increase or decrease friction between surfaces. The textures of surfaces can also be varied as textured surfaces may have higher or lower friction than smooth ones depending upon the materials and configurations of the textures. Magnets embedded into cells of the surface or sectors of connexors also can be used to increase attachment forces and/or assist in alignment and/or attachment of two mating surfaces. To make a strong or permanent interlocking of spatial components, additional locking features such as orthogonal grooves, locks, dovetails or waves may be added to connexors, such as to the surfaces of mating walls. For example a connexor having locking features is illustrated in FIG. 5*d*. Another example of a connexor having puzzle-like locking features is presented at FIG. 5*a*.

Figure 5E:
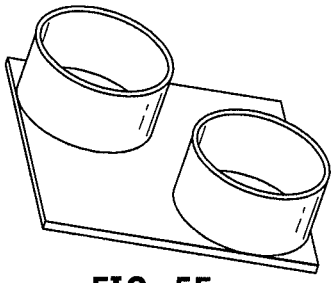
Figure 5F:
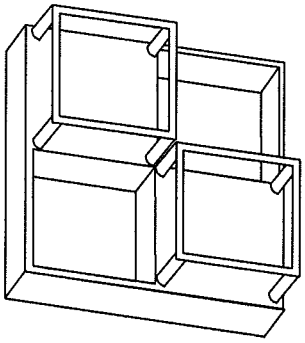

To decrease detachment forces, the area of mating contact may be reduced using connexors with smaller contact area. A principal property of mating walls is for interlocking two mating components. So some other parts of connexors surfaces may be removed while still preserving connectivity and interlocking of mating surfaces. One embodiment only includes the parts of mating wall surfaces and the parts of surface connecting them, as those may be all that are necessary for interlocking the connexing surfaces. Connexors of FIGS. 5*a*-5*c* are examples of such hollow connexors where essentially only mating walls are present. FIG. 5*e* illustrates another embodiment of hollow connexors with removed parts of cylindrical connexors. A connexor may even be a wire construction such as the empty cubic embodiments of FIG. 5*f*. Remaining parts of reduced and hollow connexors preserve contact areas of mating walls and connectivity of an article.

Two or more of the above-described approaches may be combined such as to provide necessary detachment forces and utilize different designs of mating surfaces.

If mating walls are absent, then two mating surfaces may be mated, but not fully interlocking. Unlike fully interlocking surfaces with mating walls that are orthogonal to the mating plane, which may be attached and detached only in the mating direction, mating but not fully interlocking surfaces may be attached and detached in at least one direction or range of directions other than the mating direction, such as in a conical range of directions around the mating direction. Typically such a configuration may be enough for steady constructions because there exist external restrictions and forces preventing unintentional displacement in this conical range of directions that may lead to unintentional separation and/or detachment of two mating surfaces. For example, a gravitational force may prevent unintentional vertical displacements of an object. Also a frame or other surrounding static force element around an assembly or joined components may ensure the interlocking of an assembly. Because a displacement of a surface in any direction of the conical range of direction is restricted by a frame or other force element, and all other displacements are restricted by the structure of the surface. Thus, the assembly becomes locked from displacement in any direction. A typical example of this approach is dovetail notches/joints. Two logs having such notches are not interlocking, but if a third log is added, then middle log becomes locked by the two side logs. Such an approach may be used, or example, for connexors without mating walls or 1-fold symmetrical connexors as further illustrated and described.

The border between two sectors of connexor may not be a straight line segment, but also may be a curved line. An example of such a curvilinear embodiment is illustrated in FIGS. 6*a*-6*b*. Using curves instead of straight lines may further increase the total area of mating wall surfaces, thereby allowing side forces to be distributed over a greater surface area of the connexors.

A beneficial property of articles having mating surfaces of the invention is that side forces are distributed more uniformly and over a larger surface area than in the case of an array of regular tongue-in-groove joints. These forces are also applied symmetrically to both mated surfaces. This may reduce the risk of surface deformation and destruction and may allow for using less durable and/or expensive materials and/or make smaller connexors.

There exist several planar point lattices, but only 3 are regularly spaced: a square planar point lattice, a hexagonal planar point lattice, and a rhombic planar point lattice. As such, alternative embodiments of mating connexing surfaces may be constructed using hexagonal regular planar lattices and 3-fold symmetrical connexors. An example of such a surface with 3-fold prismatic connexors is illustrated in FIG. 7*a*.2. In the same way as for a square lattice, different truncations of prism may be used, such as illustrated in FIGS. 7*b*.1-7*c*.2. A shape of an embodiment for a connexor without mating walls is the triangular pyramid with orthogonal side faces, such as illustrated in FIGS. 7*d*.1-7*d*.2. Beneficial embodiments of mating components with hexagonal lattices are components with connexing faces parallel to planes of a right octahedron.

Connexing components may have different shapes and represent different surfaces or spatial figures. Also, in some embodiments of the present invention, only a part of a surface of a spatial object may have a connexing structure. FIG. 8 represents a sphere having a part of its surface formed as a connexing surface. Such partly connexing bodies may be used as attachments to constrictions made from connexing components.

Two spatial components having connexing surfaces of the same structure may be interlocked one to another. For example, two blocks having connexing top-surface structures may be interlocked one to another by their top surfaces. Such blocks can also have connexing structure along bottom surfaces such that blocks can be joined by their top and bottom surfaces. Additionally, all side faces may also have such connexing surfaces. Such blocks can be interlocked one to another by different faces, directions and orientations.

First considered are one-sided flat connexing components or sheets. Rolls of such connexing sheets may be inexpensively produced by rotary machines. A beneficial property of one-sided connexing sheets is that they can be attached to flat facets of objects because the bottom face of a one-sided connexing sheet may also be flat. Two such objects then can be coupled one to another by these connexing facets. In general, a block with any required number of connexing faces may be made by attaching one-sided flat connexing sheets of necessary size to faces of the rectangular block.

One-sided flat sheets with prismatic connexors having heights equal to the thickness of the sheet may have a beneficial property interlocking from both sides. Interlocking from connexing sides is the designed property, but a connexing top side may also interlock with the bottom side of such sheets, because holes in the bottom side of a sheet have the same shape as positive sectors of connexing top side. This property may be beneficial for arbitrary fastening of such sheets made from flexible material for packaging (boxes, envelops, containers, sacks, etc.), handworks, games, construction paper, etc. To increase detachment forces, additional locking features may be added. Such connexing sheets can be stacked layer by layer entirely filling an arbitrary volume of space. An example of such a sheet is illustrated in FIG. 9*a*.

One-sided panels may partially overlay one another as illustrated at FIG. 9*c* to create freely expandable 2-layered flat surface structures, such as pavements, floors, walls, and roads. Two one-sided panels from different layers interlock by a corner quarters. Each panel interlocks four panels from another layer. One of the objectives of the present invention is to provide interlocking tiles of simple design to assembly layered tiled construction. A preferable minimal embodiment of one-sided connexing tiles may be a square tile having an array of 2-by-2 connexors. An example of such minimal tiles is illustrated in FIG. 9*d*. By comparison, the connexors of the tiles of the embodiment illustrated in FIG. 9*d* likely would not provide sufficiently strong interlocking between tiles of different layers if only a one-by-one connection, but four such adjacent tiles create a strong interlocking configuration with a tile of the second layer, such as illustrated at FIG. 9*h*. Other embodiments of minimal one-sided connexing tiles with of hexagonal structure are illustrated in FIGS. 9*d* and 9*e*. The assembly of puzzle-like minimal square tiles is illustrated at FIG. 9*g*. The grid embodiment illustrated at FIG. 9*b* comprising an array of the tiles of FIG. 9*d* also might be assembled in two layers creating expandable grid with twice smaller cells. Similar grids with hexagonal cells may be produced using elements of FIGS. 9*e* and 9*f*. Such hollow nodes and grids also may be used for soil and grass protection. Two-layer assemblies from one-sided connexing tiles are much stronger for front loadings than one-layer assemblies from usual tiles with side connectors, because loading is distributed to surfaces of all interlocked tiles of another layer, but not to just side connectors. In general, any connexing surface with square lattice may be decomposed into a set of minimal tiles of the same shapes comprising 2-by-2 arrays of connexors. Any tile from one layer interlocks four tiles from another layer facing it. As panels, such tiles assemblies may create freely expandable 2-layered flat surface structures, such as, but not limited to, pavements, floors, walls, and roads.

Another generic approach to create interlocking 2-layered structures is to use crisscrossed elongated tiles. FIGS. 29*a* and 29*b* illustrate 2-layered embodiments of regular "herringbone bond" and "stretcher bond" assemblies of 2-to-1 rectangular tiles. Tiles of different layers are drawn by lines of different width. The tiling embodiment illustrated in FIG. 9*i* utilizes 4-to-1 rectangular tiles and is known as "opus spicatum." A beneficial property of this embodiment is that its tiles may have a very simple shape of thin rectangular boards with slots/notches or ribs and may be produced by extrusion.

Figure 16A:
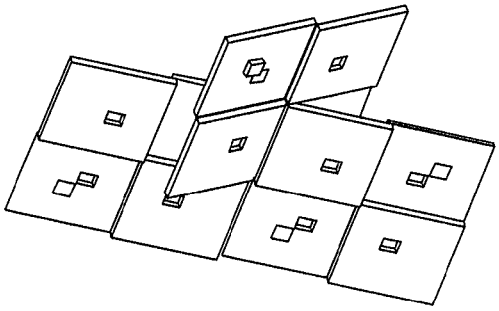
Figure 16B:
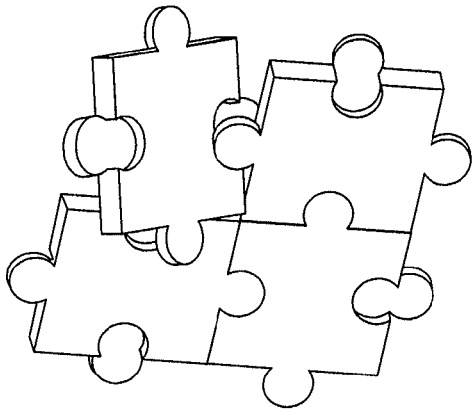

Further extensions of layered square panels and tiles are tiles with alternated connexing surfaces with coinciding mating planes but opposite mating directions. They combine four connexing surfaces or connexors in quarters of one panel, two faced up and two faced down. As for one-sided panels, each alternated panel interlocks four panels of another layer by corner quarters. An example of such panels and nodes and a corresponding assemblies are illustrated at FIGS. 16*a* and 16*b*. An alternating geometry of connexing quarters of such tiles provides easy assembling by rotation of the tile inserted into a slot between tiles of a previous row. Tiles and connexors may not be deformed during the assembly, so they may be produced from rigid or fragile materials and connexors may have comparably large sizes. These and similar assemblies may have increased resistance for both side and front loadings. Inner components of assembled constructions cannot be removed from the assembly without large mechanical deformations or destruction of components. This is a unique property of alternated connexing surfaces and components of the present invention compared to assemblies of regular blocks, which may be removed in the mating direction. Such components may be assembled into a rigid tiled surface with non-removable inner tiles in an alternated manner without any additional fastening elements. Another embodiment of alternating tiles is illustrated at FIG. 16*d*. It uses cylindrical connexors. The additional beneficial property of such locking tiles is that the whole assembly may be freely rotated and folded around axes of these cylinders. A surface of arbitrary shape with square faces maybe assembled from such tiles. Alternating tiles also may have a hexagonal structure. The assembly of hexagonal alternating tiles is illustrated in FIG. 16*e*.

Figure 16C:
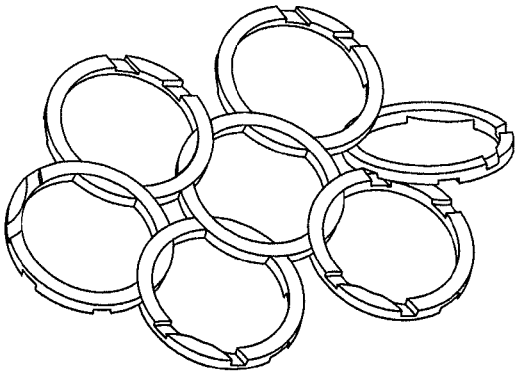
Figure 16D:
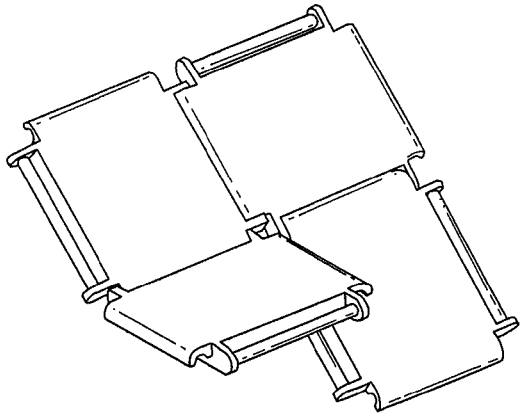
Figure 16E:
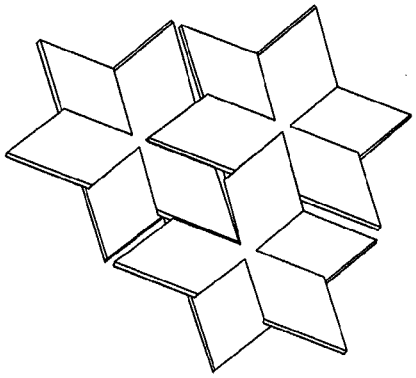

A hollow grid embodiment of such locked assembly of minimal alternating tiles is illustrated at FIG. 16*c*. Different from regular square grids, interlocking grids of embodiments of the present invention may be assembled by rotation of the cell elements inserted into a slot between cells of a previous row, but not by a welding of crossing bars. Cell elements may be produced very cheaply from corrugated wire or extruded hollow prisms and may have different designs, including square and hexagonal cells. The structure of such grid assembly resembles the structure of knitting or chain mail. Each knitted loop or ring of chain mail is also locked by four identical elements in the alternating order.

Figure 16F:
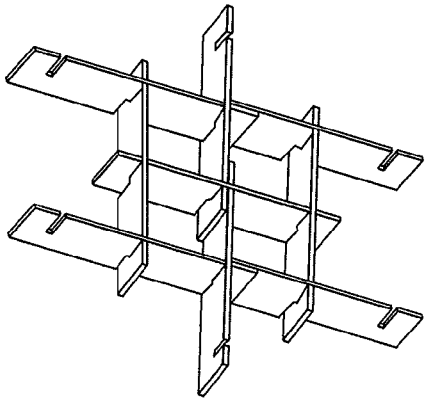
Figure 16G:
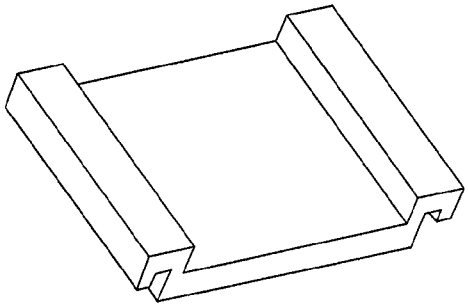
Figure 16H:
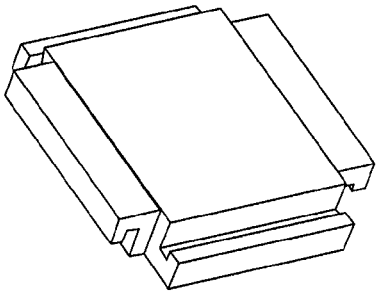
Figure 16I:
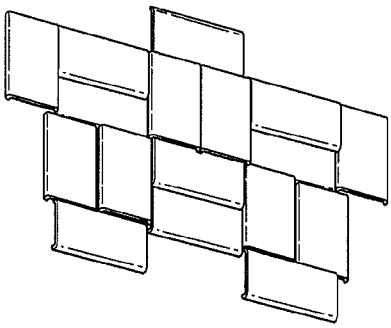
Figure 16J:
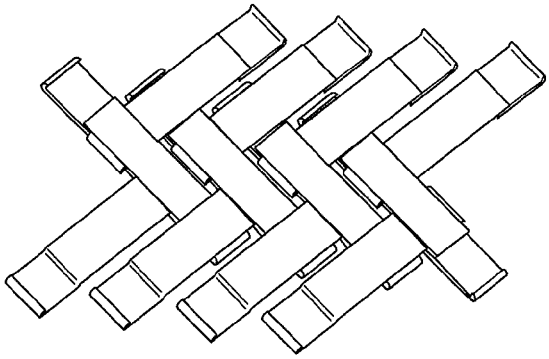

Since such tiles have an alternating structure of the surface, many of them may be assembled from two identical connexing elements as illustrated at FIGS. 16*g*-16*h*. Two flat elements in FIG. 16*g* orthogonally coupled in the middle of elements create a tile with alternated structure. It may be beneficial that elements of FIG. 16*g* may be produced very cheaply by extrusion. It is a unique property of extruded connexing elements of the present invention to create permanently locked assemblies without any additional fastening elements. The process of assembling of such elements into a panel resembles the process of weaving, and the structure of the assembled panel is very similar to crisscrossed structure of woven fabric. Another woven embodiment is illustrated at FIG. 16*f*. In general, as for regular 2-layered assemblies, alternated 2-layered woven assemblies may use different crisscrossed embodiments of elongated alternated tiles as illustrated in FIG. 16*h*-16*i*. These tiles comprise four alternating connexing surfaces or connectors: 2 surfaces in the middle and 2 surfaces with opposite mating direction at the ends of tiles. This structure provides assembling of woven 2-layered structure by rotation of the tile inserted into a slot between tiles of another layer. Inner components of assembled constructions cannot be removed from the assembly without large mechanical deformations or destruction of components. The assembly in FIG. 16*h* resembles the structure of plain weave, but the assembly in FIG. 16*i* resembles the structure of twill weave. The twill embodiment has the beneficial property that its alternated tiles may be produced by extrusion. From the same 4-to-1 alternated tiles as for the twill embodiment an assembly having the basketweave structure also may be woven. FIG. 16*f* illustrates a grid embodiment of twill weave assembled from thin notched rectangular boards. Such grids maybe folded for transportation and storage.

Moreover, as illustrated on FIG. 31 the 4-to-1 embodiment of alternated tiles may also be used for assembly of triaxial hexagonal woven structure. Such structures have many beneficial properties comparing to biaxial woven structures: they are lighter, but stronger and they don't fold under side loadings.

2-layered alternated assemblies described above may not require a strong interlocking between tiles in the frontal mating direction, because alternated structure of tiles prevents displacement of tiles from the assembly in frontal direction even without connexing surfaces. Tiles may have weak mating connexors or wider slots preserving the locked structure of the assembly. Tiles in alternated assemblies with weak connexors may be slightly displaced or rotated, and the whole assembly becomes flexible. Another unique beneficial property of alternated assemblies is that frontal loadings are distributed over all tiles of the assembly, comparing to one tile in regular 1-layer tiling or 3-4 tiles in 2-layer tiling of the present invention. This maximal possible degree of durability for frontal loadings may be beneficial for different protective surfaces, like roads, barriers, and armor.

One-sided connexing components may represent not only flat, but also any curvilinear surface. In general, the surface of a spatial object may be decomposed into two tiled layers: an inner layer and an outer layer. Tiles of each layer cover inner and outer surfaces of the object. Each tile of one layer interlocks several tiles of another layer, so the full assembly of all tiles is a strong interlocked object with surfaces identical to original object and resembling an assembly of a two-sided 3D surface puzzle of a free shape with strong interlock between elements in two layers. Surface aligned interlocking tiles are referred to herein as structiles.

An example of such a structile assembly is illustrated at FIG. 28*a*. Some structiles in the image are missing for better understanding of assembly process. Beneficially, a limited set of basic structile components may be required to build many complex constructions. For example the set comprising a square tile, the half and quarter of the square tile, the edge and the half edge, and the corner element illustrated in FIG. 28*b* allows assembly of countless arbitrary spatial constructions, which may be represented by any set of connecting unit squares. An example of a roof structure assembled from triangular one-sided structiles is illustrated at FIG. 28*c*. Two basic inner and outer one-sided structiles are illustrated at FIG. 28*d*, representing a portions of a cylindrical surface, and may provide for constructing cylindrical assemblies, such as hangars, silos, and towers. A hollow sphere or dome may be similarly assembled from 2 or more one-sided structiles. Unlike stacked layers of regular blocks, layers of one-sided curvilinear structiles are not parallel to one selected direction, but are aligned with the surface of the object. Hollow constructions assembled from such one-sided structiles representing outer and inner surfaces may be lighter but stronger than constructions assembled from regular stacked blocks, such as because of increased total area of mating walls, thereby allowing for potentially reduce building costs and resulting in stronger constructions.

A 2-sided interlocking component having top and bottom connexing surfaces is another preferred embodiment. There are two options of interposition of connexors at top and bottom connexing surfaces: alignment of sectors of connexors of opposite cells at top and bottom surfaces can be the same or different. In the first case, negative sectors are coinciding and 2-sided panels have through holes at the negative sectors if the height of prismatic connexors is equal to or less than half a cell unit. This may simplify production of such an embodiment, and it may even be produced by extrusion and cutting.

An example of such a perforated 2-sided panel with same alignment of opposite cells is illustrated in FIG. 10*a*. This symmetric 2-sided panel cut through the centers of cells can be mated from any of six sides due the similar geometry of faces from all 6 sides. Structures with many passages may be assembled from such panels. Such structures may be used for filters, and energy cells or catalysts, such as in fuel cells, where a large surface area in a small volume is important.

In case of alignment of sectors of different signs, 2-sided panels may be produced as a thin foil, such as illustrated at FIG. 10*b*. Such foil embodiments may interlock itself from both sides and, for example, may be used as construction paper or packaging material. Layers of foil may create closed air cells and, therefore, may be used for such applications as noise and heat isolation and impact absorption.

Constructions that may be made from other known regular tongue-in-groove building blocks also be made from 2-sided connexing blocks. But 2-sided interlocking blocks add additional flexibility because their top and bottom faces are identical, as well as potential additional benefits and properties of embodiments of the present invention.

Beneficial embodiments of 2-sided connexing components are rectangular bricks from which walls, floors, and other surfaces may be assembled. Due to interlocking, embodiments of bricks in accordance with the present invention may be used as bricks for mortar-less masonry and construction. FIGS. 11*a*-11*e* illustrate different embodiments of such a basic connexing bricks. FIG. 11*b* illustrates a symmetric true 3D connexing brick, which can be interlocked from any side, and FIG. 11*c* illustrates a brick with a one-fold connexor. FIG. 11*c* illustrates a brick with only one 1-fold cylindrical connexor. This brick may be assembled from extruded elements.

Connexing bricks may provide a strong interlock between individual bricks within a wall, including without mortar. They may be turned to the left or right for making corners. Moreover, some bricks may be turned up or down on end. An example of such a space-filling brick embodiment is illustrated at FIG. 11*d*. It comprises two joined one-fold connexors, each being essentially a half of the cube. One such half-and-half element interlocks with two other similar elements, and it may be mated vertically. It has been determined that combining these elements may permit making any spatial object, which can be filled by a closed spatial snake line. Adding a new element to an already assembled construction, a snake construction may turn in any of four side directions or continue forward. When returning to the first element, the assembled construction is a steady spatial object. An example of an assembly of a cube from 8 identical elements is illustrated in an exploded configuration at FIG. 12. If the inner shaded portion shown in FIG. 11*d* of these half-and-half components is hollow or conductive, then a snake assembly may be used as a segmented pipe, such as for a hollow conduit, for gas and fluid flows or conductor, or just filled, such as with foam, for better sound and/or thermal isolation.

Wire bricks may be used for assembling hollow wire structures. An example of a tetrahedral wire brick is illustrated at FIG. 11*f*. Rectangular panels from different materials may be attached to sides of such a wire brick. Walls assembled from such hollow bricks are hollow inside, but may have continuous inside and outside surfaces, even such as made from different materials. A thin brick, which may be produced by corrugation of flat panel, is illustrated at FIG. 11*e*.

Hollow connexing tile embodiments illustrated in FIGS. 11*g* and 11*h* are 2-sided extensions of hollow minimal 1-sided connexing tiles illustrated in FIGS. 9*d* and 9*e*. Such tiles may be assembled into multilayered hollow structures of arbitrary shape and be beneficial for reduction of weight of assembled construction. Hollow tiles may be used, for example, for rapid mortar-less masonry, as a substitution of sand bags for temporary military and emergency constructions, and as cells for landscape forming, flower beds, steps, soil and road enforcement. Hollow tiles may be made from thin plastic bands and may be foldable for storage and transportation purposes. Compared to regular hollow tongue-and-grove blocks, such bricks do not require precise alignment and are less sensitive to additional particles. Further, the resulting hollow assembly may be reinforced, for example, by insertion of metal rods and/or filled with materials such as sand, soil, gravel, concrete, and foam. Such an approach may simplify construction of a building or other structure and may not require additional exterior work. Another beneficial property of such hollow prismatic tiles is that tiles of different shapes may be combined in one assembly if side slots of tiles are similarly spaced as illustrated in FIG. 30.

Other beneficial embodiments of 2-sided connexing elements are notches for log and timber constructions. Notch connexors may be placed at or near the ends of a log. An example of such a notch is illustrated at FIG. 13*a*. It may be considered as a further development of a regular double notch. Notches of such disclosed design does not extend from walls and may have the same shape at all four sides. Walls assembled using timbers with such a notch may be flat. This may simplify maintenance and additional covering of such walls.

Another embodiment of a connexing notch with sloped faces is illustrated at FIG. 13*b*. The embodiment includes a symmetric slope connexor. It may be considered as a further development of a full dovetail notch. It symmetrically combines four coupled full dovetail notches from all sides. It has the same shapes from all 4 sides and does not extend from a wall, so timber walls assembled using this notch may be flat. This notch, such as shown in the embodiment of FIG. 13*c*, may be easily used even for round logs and does not require "squaring" of the log ends as for regular dovetail notches. The notch may be made, for example, by 8 similar slope cuts as illustrated in FIG. 13*c*. As shown at the right side of FIG. 13*c*, a simple template may be used for both round logs and square timbers to make the 8 slope cuts. To reduce a depth of cut, this notch may be combined with other types of flat notches, such as a halved or square notch, adding additional interlocking properties. Angles of a slope for a cut also may be reduced for shallower cuts. Such notches as described above may be resistant to shrinkage and other log deformations. For example, sloped surfaces may help to prevent penetration of water. Also, due to its symmetric structure, this notch may be easily made at any place along a log, so the log may mate with orthogonal logs not only at the log ends, but at any place in the middle of the logs, too. This may simplify construction of interior walls of a structure. Therefore, such notches may be widely used for the building of beam, log, and timber constructions.

Figure 14A:
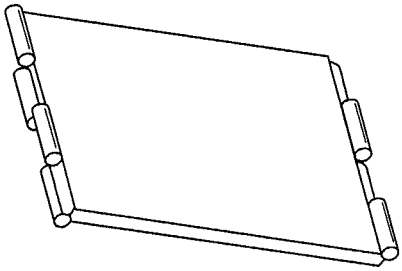
Figure 14B:
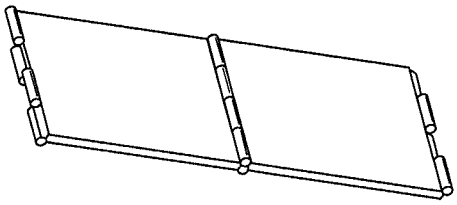
Figure 14C:
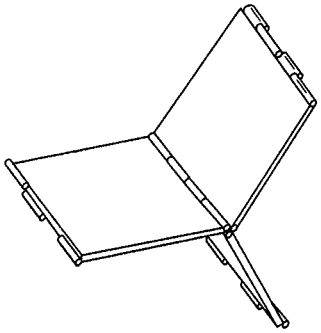
Figure 14D:
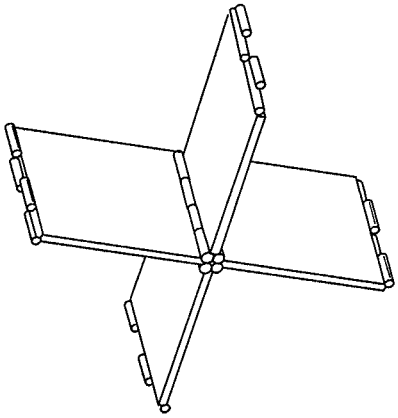
Figure 15A:
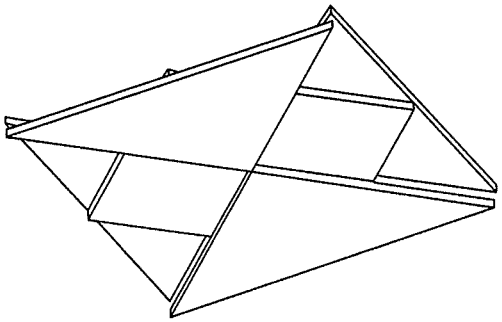
Figure 15B:
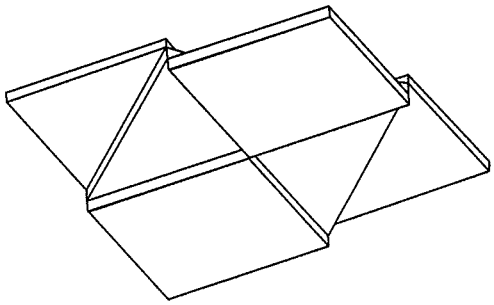
Figure 15C:
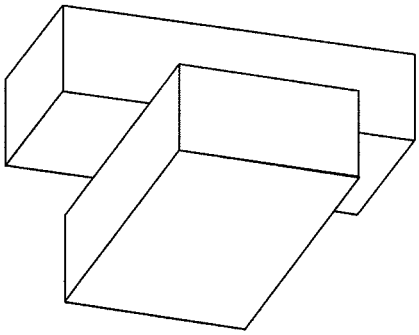
Figure 15D:
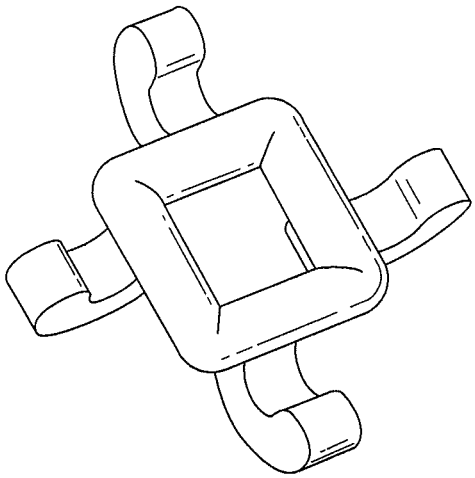

Other beneficial embodiments of 2-sided blocks are thin panels with connexing side (end) faces. One preferred embodiment of sector elements of a connexor in this case is a side-aligned cylinder. FIG. 14*a* presents a rectangular band with connexing sides of such a design. Additional locking features may be added to the top and bottom faces of cylinders. A rod connecting adjacent bands and passing through centers of cylinders may also be used. Such panels may be mated by rows of cylinders at any angle from 0 degrees when panels are attached to each other by neutral faces to 180 degrees when panels are mated by both rows of cylinders as illustrated at FIG. 14*b*. A set of such bands may be folded into a compact form of or unfolded into a strong, flat, thin rectangle. Such embodiments may be used for different temporary flat surfaces, such as for barriers, walls, doors, and curtains.

The cylindrical connexing side (end) face also provides another beneficial property of such panels. Any number of such panels may be mated to each other by side faces as illustrated, for example, at FIG. 14*c* for 3 panels and at FIG. 14*d* for 4 panels. This provides a possibility to build cubicles, guiding and shadow walls, playhouses, and other temporary wall and similar permanent and temporary constructions. Assembled walls may have windows and doors. Additional features covering edges may be added to make assembled structures resistant or impermeable to wind and water.

Another beneficial embodiment of a connexing component is a right polygonal prism with connexing side faces. A preferred embodiment of the prism is a square prism. An example of a component having 4 side faces with 2 and 1-fold connexors in the centers of the side faces is illustrated in FIGS. 15*a*-15*d*. Such 4-sided connexing node elements may be assembled into different constructions and may fill an arbitrary spatial or planar shape creating a steady interlocked assembly because the assemblies from such nodes may be extended in all three directions. Due to the large sizes of connexors and horizontal interlocking, embodiments of 4-sided nodes in FIGS. 15*a*-15*d* have increased contact surfaces and resistance to front loads compared to regular tiles with vertical interlocking and can be used, for example, for pavements, roads, and floors. Components in FIG. 15*c* and 15*d* have alternating structure of their sectors. If their inner mating faces are connexing surfaces, then assemblies of these components illustrated at FIGS. 32*a* and 32*b* provide compete locking of internal components. Therefore, such components also maybe considered as alternating tiles.

The embodiment of a 4-sided connexing node illustrated at FIG. 17*a* uses a diagonal dodecahedron connexor and comprises 5 regular rhombic dodecahedrons in a cross shape. Such components interlock each other and interlockably fill the entire space. A feature of this preferred embodiment is that it is the simplest interlocking space-filling polyhedral body having all faces of the same shape. A spatial body may be assembled having dodecahedron cells of such component. A dodecahedron cell is closer to spherical shape and is typically stronger than a cubic cell. A pentacomb embodiment may be considered as the minimal interlocking space cell.

Like other 4-sided nodes, pentacombs may be assembled into beams and panels. Assembled beams and panels have a specific beneficial property; they may be interlocked from all 6 sides because surfaces of 2 pentacombs mated with a central pentacomb as illustrated in FIG. 17*b* create interlocking surfaces of the same structure at originally neutral sides of the central pentacomb. Pentacomb beams and panels also may be made as a solid article without assembling from individual pentacombs.

Another preferred embodiment of prismatic components is an elongated beam with a row of connexors along side faces. In many cases, only orthogonal connections between beams are required, for example for construction of rectangular frame structures. In such cases, 2-fold symmetry of a connexor is not needed, and just I-fold symmetrical connexors may be used. For example, using rectangular connexors and removing some unnecessary parts, a ladder-style 4-side beam may be constructed, such as illustrated in FIG. 18*a*. Another embodiment of 4-sided interlocking beams is presented in FIG. 18*b*. Each element of a connexor of this beam occupies ⅙ of a unit cube. So beams line the one illustrated in FIG. 18*b* not only interlock each other orthogonally, but also a full assembly of such beams interlocks in 3 directions and fills the entire space. Such beams may be mated orthogonally and may be used, for example, for assembling storage systems and other frame constructions.

Other embodiments of prismatic components are panels with connexing side faces with edge-aligned cylindrical connexors. Such panels provide the properties of 2-sided panels, so, for example, wall structures may be assembled from them. Additionally, instead of a rectangle, any polygon maybe used with the same connexing structure added to the sides of the polygon, as illustrated in FIG. 19. Side-connexing polygons also may be mated at any angle with other side-connexing polygons and assembled into not only arbitrary polygonal bodies, but also any arbitrary spatial tessellations. To make a construction more permanent and/or resilient, additional locking features and/or cylindrical rods passing though centers of cylinders may be added. Similarly, from like triangular elements having right angle and vertex coordinates {(0,0,0), (1,0,0),(1,1,1)} both vertical walls and roofs of arbitrary shapes may be constructed.

Rectangular blocks are one beneficial embodiment of interlocking components because they are a commonly used element of different constructions and many properties of a rectangular block embodiment of interlocking components are applicable for the case of an arbitral interlocking component of the invention. One objective of this embodiment of the invention relates to different properties and applications of such interlocking blocks with different number of connexing faces.

Dimensions of embodiments of rectangular blocks are multiples of the unit size of the cell, and edges of blocks are aligned with axes of symmetry of the face lattices. One objective of this embodiment of the invention relates to different properties and applications of such aligned connexing blocks of different dimensions including special cases of nodes 1×1×1, beams 1×1×N, and panels 1×M×N.

The main embodiments of connexing blocks are 6-sided blocks. Such a connexing block with cylindrical element connexors illustrated in FIG. 20. Properties of such blocks are similar to 4-sided blocks, but have some different and additional characteristics. For a connexing 6-side block with axial-aligned sectored connexors there always exist 2 negative sectors adjacent to each other at an edge of the block. So if positive sectors of other connexing blocks are attached to these negative sectors, then 2 corresponding positive sectors might not fit into corresponding negative sectors at the edge of the block, such as illustrated at FIG. 21. Positive sectors of one block may not be inserted into a negative sector of another block, because another positive sector in an attached block already protrudes into the space. This adds a restriction to the geometry of such a connexors and its block. Another issue is preservation of common mating pattern at the surface of an assembly because after mating, the mating pattern of resulting blocks may not be continuous.

To resolve these issues, several solutions are proposed. For a 6-sided block with regular connexors there are adjacent negative side cells and adjacent positive side cells at the edges. To resolve the issue, edge cells of the block may be partially or completely removed as illustrated in the embodiment of FIG. 22. Such blocks should have even dimensions of connexing parts to preserve common pattern. Similarly, positive edge connexors may be truncated so that they occupy only a portion of a mated negative edge connexor, thereby allowing for one or more similarly truncated positive edge connexors to be mated and occupy at least a portion of the negative edge connexor that would have been occupied by a non-truncated positive edge connexor.

Another generic solution for this issue of connexing blocks was found that, to have arbitrary mating of 6-sided connexing blocks, the axial connexor surface may be disposed within an octahedron based on the unit cell as illustrated in FIG. 23. To preserve the common pattern of the assembly segments near each corner of a block should have the same sign. A 6-sided block fulfilling each of these conditions is illustrated at FIG. 20. There are no known blocks that satisfy these conditions. But embodiments of blocks of the present invention may be compatible, or at least partially compatible, with some known blocks where the shapes and dimensions of each cooperate to allow for mating. And to help make 6-sided blocks partially compatible with known blocks, such as LEGO blocks, the height of the connexors may be reduced.

Another embodiment for a 6-sided block is a block with diagonal sectored connexor. In this case adjacent negative sectors at edges of blocks may be easily avoided. Embodiments of 6-sided nodes with cylinder and rhombic dodecahedron sectored connexors are respectively illustrated in FIGS. 24*a*-24*b*. From such nodes, a block of any size may be assembled that preserves a common connexing pattern over the surface of the assembly. Like 4-sided prismatic pentacomb nodes, these 6-sided nodes may fill any space volume and represent an arbitrary cellular body. It also should be noted that the node in FIG. 24*b* combines both square and hexagonal connexors and may be mated in 14 directions.

Another embodiment of connexing blocks is an intersection of orthogonal 2-sided connexing blocks. A sector of connexor for such an embodiment has a 90-degree rotational symmetry around all three central axes. One embodiment for such a sector surface is a cube symmetrically truncated from all three directions.

An embodiment of a 1×1×1 node that is an intersection of 3 orthogonal panels having all connexing surfaces is illustrated in FIG. 25*a*. FIG. 25*b* illustrates a 1×1×n beam that is an intersection of 2 panels and 1 block. And FIG. 25*c* illustrates a 1×n×m connexing panel that is an intersection of 1 panel and 2 blocks. Beams and panels may have different sizes and can be joined to create different frame structures. Since these basic rectangular components may be interlocked along any connexing side, an unlimited variety of spatial constructions may be created from such simple uniform components because two such components can be joined one to another by any of their faces.

Various methods may be used for manufacturing the above-described structures and other embodiments in accordance with the present invention. As described above, one way to produce connexing objects including blocks is to attach one-sided connexing panels of necessary shapes to flat faces of the object. Some simple shapes like blocks also can be made by corrugating one-sided flat templates.

Some connexing components may be produced by different molding methods. This is a cost-effective method for mass production of connexing panels having no overhanging elements such that preforms. Some connexing panels have identical top and bottom surfaces with a uniform distance therebetween. Such panels may be stamped from sheets of uniform thickness. Connexing panels that have completely periodic structures may be produced by a rolling corrugating press. As mentioned above some hollow connexing components can be produced by extrusion of a material and cutting the extrusion into the desired length(s) for connexing parts.

A limitation of stamping and corrugating manufacturing is that the thickness of the stamped material should be close to the size of the desired cell. Structures with large hollow cells may be made by removing unnecessary parts of cells or assembled from parts having opposing surface structures corresponding to desired top and bottom surface structures. These parts may be the same and can be joined together by internal hollow connexing cells. Another generic method of production of hollow components is rotomolding.

Individual cells, parts, or entire components having connexing structures may be produced from different materials, including wood, glass, metal, plastic, rubber, polymer, concrete, composite, and foam materials. They may be soft, flexible, or rigid. They may have different textures, colors, transparencies, reflectivity and/or reflective elements, and other visual and tactile properties. They may have embedded elements such as light emitting diodes (LEDs) and radio frequency identification (RFID) elements. Thus, a variety of effects and properties may be provided in the above-mentioned connexing structures.

Different coatings can be used to cover the surfaces of bodies, connexors, connexing surfaces, or assembled constructions. Coatings can further increase the strength of a construction, fill gaps, protect the construction from environment, and also smooth the surface of a construction. Assembled constructions can be additionally painted and decorated.

Connexing structures described herein may be used in a broad range of applications, not all of which applications are described herein. Generally, almost any application, in which the interconnections of parts are desired, may benefit from using structures disclosed above. Thus only a limited set of possible applications for different embodiments of the invention are described herein.

Connexing elements can be used as toy building sets for children. Nodes, beams, and panels of different shapes can be connected by different angles providing construction possibilities for a variety of spatial shapes. Assembled constructions may have rotational parts. Additional elements with connexing faces like wheels, small figures, and different decorative details may further increase usability and attraction of assembled objects.

Cells of connexing elements may be colored with different colors, may be transparent, and may have different truncations. Connexors and blocks may be free of sharp edges and small extensions for the blocks to be kid-friendly. Attaching and detaching forces can be adjusted for easily assembled but rigid constructions. Cells also can be made from soft and flexible materials. Blocks with larger cells or with simple mating may be used for younger children, and more complex blocks may be enjoyable and/or present challenges of construction for older children, young adults, and even adults.

A variety of useful objects can be assembled from such nodes, beams, panels and blocks, such as buildings, pavements, furniture, houses and play yards, climbing constructions, and temporary storage containers. As mentioned above, decorative elements may be attached to faces of assembled objects.

In general, any arbitrary body may be decomposed onto a set of parallel hollow connexing panels and then re-assembled from these panels. Hollow connexing panels provide a cost efficient way for production of strong cellular articles of arbitrary shape. At the first stage, a body is represented by slices determined by a set of parallel planes with unit distance between the planes. Then, top and bottom surfaces of each slice are converted into hollow connexing surfaces, and each slice becomes a one- or two-sided connexing panel. The resulting object is assembled from these panels. It will have the same surface as the original article, will have strong interlocking between panels, and will consist of hollow cells. Each panel slice may be produced using injection molding. This method provides a cost efficient way for production of large articles and/or articles having a complex surface, which as a whole may not be capable of being produced by injection molding. This production method may be utilized as a type of rapid prototyping.

Thin 1- or 2-sided connexing sheets may be used as a construction paper. Shapes may be cut from it such as using regular scissors or a cutter, and attached one to another without glue. Various articles may be made from one or more pieces of such material such as boxes, envelopes, and sacks. Only mating areas of articles need be connexing.

Connexing panels may be used as object holders. For example, letters, numbers, and other objects with connexing back side may be attached to a connexing panel to create texts, collages, images, mosaics, and holding panels. This may prevent the displacement of objects and provide for ease in attaching and detaching objects relative to the base holding panel. Embodiments of the present invention maybe useful for a number of table games, in which many pieces should be placed into specified positions and maybe even multiple layers, including chess, sudoku, mahjong, dominos, different pentamino games, etc. Embodiments of the present invention may also be used as substitutions for magnetic or cork boards, assembled billboards, displays, etc.

Simple node connexors may be used as snap buttons or buckles. Compared to existing snap buttons, connexing snap buttons can be easily sewed to a fabric and be constructed from just two identical parts. They can be hidden and can be arranged so that fabrics are not deformed and holes are not required. An example of such a snap button is presented in FIG. 26*a*. The illustrated snap button is capable of interlocking engagement with another identical button. If such connexors are placed into a row to produce a linear locking structure, then such a linear locking structure may interlock with a similar linear structure. The design of such a fastener is illustrated in FIG. 26*b*. It can be manufactured from four similar linear elements. Another modification of a fastener with an array of flexible connexing fingers is also possible. An example of the array fastener of this type with additional locking features is illustrated at FIG. 26*c*. It can be simply and cost-efficiently produced by a rolling press. Such buttons, buckles, zippers, and fasteners may be used for clothes, footwear, bags, purses, and other objects. An area fastener refers to a fastener defined over a two-dimensional area, similar to two-dimensional areas of hook and loop fasteners.

Connexing panels also can be used as electric connectors joining multiple conductors. Inner mating walls of cells can include conductive materials and can be connected to corresponding conductors. Such uniform connectors may provide reliable connections of many wires and complete isolation of conductive parts. FIG. 27*a* illustrates a four-wire 2×2 connector having conductive parts 40. This connector provides up to four connections, such as used for a USB interface. Another example of a connector for many wires, for example for digital video or processor interfaces, is illustrated in FIG. 27*b*. If all inner mating walls are conductive then this connector provides twenty-four connections. Varying the number of cells, connectors for different interfaces including RS-232, IEEE 1284 parallel, FireWire, HDMI, DVI, ATI, and others may be designed. And both parts of such connectors may be identical. Rotationally symmetric connexing connectors may also be designed to accommodate and function when mated at any possible rotation. Electrical connections to conductive parts of connexing connectors may be dynamically aligned by automatic electrical switching of the connections to match the rotational mating, such as detected by a sensor of one part of the connection. Alternatively, conductive parts of connexing connectors may be configured in rotational symmetry to accommodate for more than one rotational mating, such as employing a radial arrangement of conductive parts, thereby essentially creating rings of corresponding conductive parts. Thus, a user may not need to align an electrical connector, and may further not potentially cause damage to the electrical connector or electrical device thereof by connecting or forcible attempting to connect the electrical connector not in a required alignment.

Such conductive connectors can be used for assembling complex electronic structures from basic electronic blocks also having connexing surfaces. They provide a strong fixation of basic blocks one to another or some baseboard and wide communication interfaces. Three-dimensional electronic structures assembled as such can have wide interfaces and occupy smaller spaces than usual 2-dimensional structures. Additional cavities can be added to provide better thermal properties.

Another application for embodiments of the invention relates to complex electronic devices, which require customization. For example, a processing block can be joined with a separate power block, a memory device block, a disc-drive block, and other specialized blocks to assemble a computer or some other electronic device. Such basic blocks may be freely joined to build devices with desired properties. They may have similar sizes and be stacked together. For example, a DVD block maybe added when desired, a battery block may be added for mobile users, a higher power graphic block may be used at home to play games, and any additional hardware maybe inserted into PCI blocks. Large office displays can be substituted to smaller ones for mobile applications. Instead of carrying a whole computer, a user may only carry a hard disc drive or other detachable storage device and attach it to any processing device. This approach removes differences between desktop computers and mobile computers. Users can assemble configurations which best fit their needs. The operating system of such a device may support such flexibility and provide support for dynamic reconfigurations.

As described above, embodiments of connexors and structiles according to the present invention may be formed from or comprise different materials, such as, but not limited to, one or more of the following materials and types of such materials: wood, glass, metal, plastic, polymer, concrete, composite, and foam. For example, one embodiment may be molded from one material and coated with another material, such as a plastic mold covered with a metal coating over at least a portion of the connexor, as may be beneficial for the wire connexors of FIGS. 27*a* and 27*b*. Materials may be selected to create connexors that are flexible or to create connexors that are rigid. Similarly, materials may be selected to create sectored connectors that are flexible or to create sectored connectors that are rigid. Similarly, embodiments of connexors and structiles according to the present invention may include one or more different textures, colors, transparencies, reflectivity, or other visual or tactile characteristic, such as connexor with positive sectored elements of a first color and negative sectored elements of a second color as may be beneficial to aid in a visual understanding of the interlocking property of connexors and structiles of the present invention.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims.

That which is claimed:

1. A continuous connexing surface configured to be partitioned into a plurality of abutting spatial components, wherein the connexing surface is defined by a periodic planar lattice, wherein the connexing surface defines a mating plane and an orthogonal mating direction, and wherein the lattice is defined in a plane parallel to the mating plane, the connexing surface comprising:

a plurality of substantially identical positive form sectored elements comprising nodes of the lattice;

at least one connecting member extending between and connecting the positive form sectored elements; and a plurality of negative form sectored elements at least partially defined by at least one of (a) the adjacent positive form sectored elements or (b) the adjacent connecting members, wherein each negative form sectored element comprises an open space extending through the connexing surface in the orthogonal mating direction, wherein each spatial component comprises at least:

a portion of at least one of the positive form sectored elements, a portion of at least one of the connecting members, and a portion of at least one of the negative form sectored elements, and wherein the connexing surface is configured to interlock with at least a portion of a substantially identical connexing surface with positive form sectored elements of one connexing surface configured to mate with negative form sectored elements of the other connexing surface.

2. A composition comprising a continuous connexing surface defined by a periodic planar lattice, wherein the composition is configured to be partitioned into a plurality of adjacent, abutting, and substantially identical spatial components, wherein the connexing surface defines a mating plane and an orthogonal mating direction, wherein the connexing surface comprises:

a plurality of substantially identical positive form sectored elements comprising nodes of the lattice;

at least one connecting member extending between and connecting the positive form sectored elements; and a plurality of negative form sectored elements at least partially defined by at least one of (a) the adjacent positive form sectored elements or (b) the adjacent connecting members, wherein each negative form sectored element comprises an open space extending through the connexing surface in the orthogonal mating direction, and wherein each spatial component comprises at least:

a portion of at least one of the positive form sectored elements, a portion of at least one of the connecting members, and a portion of at least one of the negative form sectored elements, such that at least two abutting spatial components defining one connexing surface are configured to interlock with at least two additional abutting spatial components defining another connexing surface with at least some positive form sectored elements of the one connexing surface configured to mate with corresponding negative form sectored elements of the other connexing surface.

3. An assembly comprising at least two compositions of interlocking spatial components, wherein each composition comprises:

a continuous connexing surface defined by a periodic planar lattice, wherein the composition is configured to be partitioned into a plurality of adjacent, abutting, and substantially identical spatial components, wherein the connexing surface comprises:

a plurality of substantially identical positive form sectored elements comprising nodes of the lattice;

at least one connecting member extending between and connecting the positive form sectored elements; and a plurality of negative form sectored elements at least partially defined by at least one of (a) the adjacent positive form sectored elements or (b) the adjacent connecting members, wherein each spatial component comprises at least:

a portion of at least one of the positive form sectored elements, a portion of at least one of the connecting members, and a portion of at least one of the negative form sectored elements, wherein the assembly comprise one composition of interlocking spatial components defining one connexing surface interlocked with at least a portion of another substantially identical composition of interlocking spatial components defining another connexing surface, with at least some positive form sectored elements of the one connexing surface mated with corresponding negative form sectored elements of the other connexing surface.

4. An assembly of claim 3, wherein each negative form sectored element comprises an open space extending through the connexing surface in the orthogonal mating direction.

5. The connexing surface of claim 1, wherein the positive form sectored elements comprise electrically conductive portions, wherein the connexing surface is configured to define a multi-channel electrical connection interface.

6. The connexing surface of claim 1, wherein the at least one connecting member comprises flexible connexing fingers.

7. The connexing surface of claim 1, wherein the at least one connecting member comprises a sheet in the mating plane.

8. The connexing surface of claim 1, wherein the at least one connecting member is rigid.

9. The connexing surface of claim 1, wherein the positive form sectored elements comprise flexible locking features.

10. The connexing surface of claim 1, wherein the positive form sectored elements are prisms that extend in the orthogonal mating direction.

11. The connexing surface of claim 1, wherein each positive form sectored element comprises an opening extending therethrough in the orthogonal mating direction.

12. The connexing surface of claim 1, wherein the periodic lattice is a triangular lattice.

13. The composition of claim 2, wherein the composition comprises two opposing connexing surfaces.

14. The composition of claim 2, wherein each interlocking spatial component is bounded by a plurality of planes, wherein each plane extends in the orthogonal mating direction and passes through at least one of the nodes of the lattice.

15. The composition of claim 14, wherein each plane extends in the orthogonal mating direction and passes through a plurality of adjacent nodes and connecting members of the lattice.

16. The composition of claim 14, wherein each plane extends in the orthogonal mating direction and passes through the centers of a plurality of negative sectored elements of the lattice.

17. The composition of claim 2, wherein the interlocking spatial component is deformable when the interlocking spatial component is not engaged with another interlocking spatial component, and wherein the interlocking spatial component is substantially rigid when the interlocking spatial component is engaged with the other interlocking spatial component.

18. The composition of claim 2, wherein, for each interlocking spatial component, each positive form sectored element comprises an opening extending therethrough in the orthogonal mating direction.

19. The assembly of claim 3, wherein the connecting members are flexible connexing fingers, and wherein the assembly is a rigid structure.

20. The assembly of claim 4, wherein each positive form sectored element comprises an opening extending in the orthogonal mating direction through the respective connexing surface that is configured to align with the open space of the negative form sectored element of the other interlocking connexing surface, such that the assembly defines a plurality of through holes therethrough.

21. The assembly of claim 20, wherein the plurality of through holes is configured to receive at least one of air flow, fluid flow, grass roots, vegetation, piping, cables, or conduits.

22. The assembly of claim 3, wherein the connecting members of each connexing surface comprise a sheet in the mating plane such that the assembly comprises two layers with the positive form sectored elements of the respective compositions of interlocking spatial components disposed therebetween.

23. The assembly of claim 22, wherein the assembly is configured to cover a portion of at least one of a floor, a wall, a ceiling, a roof, a sidewalk, a deck, a patio, a fence, a barrier, an armor, a parking place, a driveway, grass, a slope, a construction toy, or a road.

24. The assembly of claim 3, wherein at least one of the compositions of interlocking spatial components defines a front face and a rear face, and wherein the connexing surface is defined by at least one of the front face or the rear face such that the composition is configured to interlock with at least a portion of at least one other composition from either the front face or the rear face via respective connexing surfaces.

25. The assembly of claim 24, wherein the assembly comprises a multilayer structure.

26. The assembly of claim 3, wherein the assembly forms at least part of a wall, a fence, a barrier, a construction toy, or a space filler.

* * * * *